US007884324B2

(12) United States Patent
Blick et al.

(10) Patent No.: US 7,884,324 B2
(45) Date of Patent: Feb. 8, 2011

(54) NANOPILLAR ARRAYS FOR ELECTRON EMISSION

(75) Inventors: Robert H. Blick, Madison, WI (US); Michael S. Westphall, Fitchburg, WI (US); Hua Qin, Madison, WI (US); Lloyd M. Smith, Madison, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 460 days.

(21) Appl. No.: 12/130,103

(22) Filed: May 30, 2008

(65) Prior Publication Data

US 2009/0321633 A1 Dec. 31, 2009

Related U.S. Application Data

(60) Provisional application No. 60/941,675, filed on Jun. 3, 2007.

(51) Int. Cl.
*G01N 23/00* (2006.01)
*G01N 13/10* (2006.01)
*H01J 49/08* (2006.01)

(52) U.S. Cl. ..... 250/310; 250/307; 250/306; 250/492.2; 250/493.1; 250/397; 250/399; 257/10; 977/762

(58) Field of Classification Search ..... 250/310, 250/306, 307, 492.2, 493.1, 397, 399; 257/10; 977/762
See application file for complete search history.

(56) References Cited

U.S. PATENT DOCUMENTS 4,060,823 A 11/1977 Howorth et al.
4,303,930 A 12/1981 Can Gorkom et al.
5,138,402 A * 8/1992 Tsukamoto et al. ..... 257/471
5,814,832 A * 9/1998 Takeda et al. ..... 257/10
6,722,200 B2 4/2004 Roukes et al.

(Continued)

FOREIGN PATENT DOCUMENTS

DE 199 61 811 7/2001

(Continued)

OTHER PUBLICATIONS

Aebersold et al. (Mar. 13, 2003) "Mass Spectrometry-Based Proteomics," *Nature* 422:198-207.

(Continued)

*Primary Examiner*—Nikita Wells
(74) *Attorney, Agent, or Firm*—Greenlee Sullivan P.C.

(57) ABSTRACT

The present invention provides systems, devices, device components and structures for modulating the intensity and/or energies of electrons, including a beam of incident electrons. In some embodiments, for example, the present invention provides nano-structured semiconductor membrane structures capable of generating secondary electron emission. Nano-structured semiconductor membranes of this aspect of the present invention include membranes having an array of nanopillar structures capable of providing electron emission for amplification, filtering and/or detection of incident radiation, for example secondary electron emission and/or field emission. Nano-structured semiconductor membranes of the present invention are useful as converters wherein interaction of incident primary electrons and nanopillars of the nanopillar array generates secondary emission. Nano-structured semiconductor membranes of this aspect of the present invention are also useful as directed charge amplifiers wherein secondary emission from a nanopillar array provides gain functionality for increasing the intensity of radiation comprising incident electrons.

32 Claims, 15 Drawing Sheets

U.S. PATENT DOCUMENTS

| | | | | |
|---|---|---|---|---|
| 7,041,611 | B2 * | 5/2006 | Blick et al. | 438/10 |
| 7,408,147 | B2 * | 8/2008 | Blick et al. | 250/251 |
| 2002/0166962 | A1 | 11/2002 | Roukes et al. | |
| 2007/0023621 | A1 | 2/2007 | Blick et al. | |

FOREIGN PATENT DOCUMENTS

| | | |
|---|---|---|
| WO | WO 02/12443 | 2/2002 |
| WO | WO 03/095616 | 11/2003 |
| WO | WO 03/095617 | 11/2003 |
| WO | WO 2004/041998 | 5/2004 |
| WO | WO 2007/016113 | 2/2007 |

OTHER PUBLICATIONS

Armour et al. (2002)"Transport Via a Quantum Shuttle," *Phys. Rev. B* 66:035333.

Barker et al. (2005) *Modern Microwave and Millimeter-Wave Power Electronics*, IEEE Press, Wiley, N.J., CH. 4,7,8,15.

Beil et al. (2003) "Comparing Schemes of Displacement Detection and Subharmonic Generation in Nanomachined Mechanical Resonators," *Nanotechnology*. 14:799-802.

Beil et al. (2002) "p2-21: Broadband Acoustical Tuning of Nano-Electrochemical Sensors," *Proc. IEEE Sensor* 1:1285-1289.

Blick et al. (2004) "Nano-Electromechanical Transistor Operated as a Bi-Polar Current Switch," *Proceedings of the 4h IEEE Conference on Nanotechnology*, 258-259.

Blick et al. (2003) "A Quantum Electromechanical Device: The Electromechanical Single-Electron Pillar," *Superlatices and Microstructures* 33(5-6):397-403.

Blick et al. (Dec. 25, 1995) "Photon-Assisted Tunneling Through a Quantum Dot at High Microwave Frequencies," *Appl. Phys. Lett.* 67(26):3924.

Blick et al. (Aug. 15, 2002) "Nanostructures Silicon for Studying Fundamental Aspects of Nanomechanics," *J. Phys: Condens. Matter* 14:R905-R945.

Brattain et al. (Jan. 1953) "Surface Properties of Germainium," *Bell Syst. Tech. J.* 32:1-41.

Browning et al. (1993) "Atomic-Resolution Chemical Analysis Using a Scanning Transmission Electron Microscope," *Nature* 366:143-146.

Bruining, H. (1954) "Thin Film Field Emission," In; *Physics and Applications of Secondary Electron Emission*, McGraw-Hill Book Co., Inc: New York. pp. 59-63.

Buldum et al. (Dec. 5, 2003) "Electron Field Emission Properties of Closed Carbon Nanotubes," *Phys. Rev. Lett.* 91(23):236801.

Crewe et al. (Jun. 12, 1970) "Visibility of Single Atoms," *Science* 168:1338-1340.

Crewe et al. (Feb. 1969) "A Simple Scanning Electron Microscope," *Rev. Sci. Instrum.* 40(2):241-246.

Cruz et al. (2005) "Field Emission Characteristics of a Tungsten Microelectromechanical System Device," *Appl. Phys. Lett.* 86(153502):1-3.

Deshmukh et al. (Sep. 13, 1999) "Nanofabrication Using a Stencil Mask," *Appl. Phys. Lett.*75(11):1631-1633.

Driskill-Smith et al. (Nov. 24, 1997) "Nanoscale Field Emission Structures for Ultra-Low Voltage Operation at Atmospheric Pressure," *Appl. Phys. Lett.* 71(21):3159-3161.

Driskill-Smith (Nov./Dec. 1997) "Fabrication and Behavior of Nanoscale Field Emission Structures," *J. Vac. Sci. Technol. B* 15(6):2773-2776.

Driskill-Smith et al. (Nov. 1, 1999) "The 'Nanotriode': A Nanoscale Field-Emission Tube," *Appl. Phys. Lett.* 75(18):2845-2847.

Ekinci et al. (May 31, 2004) Ultrasensitive Nanoelectromechanical Mass Detection *Appl. Phys. Lett.* 84(22):4469-4471.

Erbe et al. (Nov. 6, 2000) "Mechanical Mixing in Nonlinear Nanomechanical Resonators," *Appl. Phys. Lett.* 77(19):3102-3104.

Forbes et al. (Mar./Apr.1999) "Field-Emission: New Theory for the Derivation of Emission Area from a Fowler—Nordheim Plot," *J. Vac. Sci Technol. B* 17(2):526-533.

Fursey, G. (2005)"Mass-Spectrometers with Field Emission Cathodes," In; *Field Emission in Vacuum Microelectronics*, Kluwer Academic/Plenum Publishers, New York, pp. 159-160.

Geis et al. (Jun. 14, 1998) "A New Surface Electron-Emission Mechanism in Diamond Cathodes," *Nature* 393:431-435.

Huang et al. (Jan. 30, 2003) "Nanoelectromechanical Systems: Nanodevice Motion at Microwave Frequencies," *Nature* 421:496.

Ilic et al. (2005) "Enumeration of DNA Molecules Bound to a Nanomechanical Oscillator," *Nano Lett.* 5(5):925-929.

International Search Report and Written Opinion, Corresponding to International Application No. PCT/US06/28888, Mailed Jul. 11, 2008.

Jensen et al. (Jul./Aug. 1998) "Advanced Emitters for Next Generation of Amplifiers," *J. Vac. Sci. Technol. B* 16(4):2038-2048.

Jensen et al (Jul. 15, 1997) "Space Charge Effects on the Current-Voltage Characteristics of Gated Field Emitter Arrays," *J. Appl. Phys.* 82(2):845-854.

Johnson et al. (Feb. 15, 1954) "Secondary Electron Emission from Germanium," Phys. Rev. 93(4):668-672.

Kamiya et al. (Sep. 29, 1997) "Secondary Electron Emission from Boron-Doped Diamond Under Ion Impact: Applications in Single-Ion Detection," *Appl. Phys. Lett.* 71(13):1875-1877.

Kanter, H. (Feb. 1, 1961) "Energy Dissipation and Secondary Electron Emission in Solids," *Phys. Rev.* 121(3):677-681.

Kim et al. (Sep. 20, 2004) "Bonding Silicon-on-Insulator to Glass Wafers for Integrated Bio-electronic Circuits," *Appl. Phys. Lett.* 85:2370-2372.

Kim et al. (Feb. 14, 2007) "Field Emission from a Single Nanomechanical Pillar," *Nanotechnology* 18(6):065201.

Kirschbaum et al. (Jul. 8, 2002) "Integrating Suspended Quantum Dot Circuits for Applications in Nanomechanics,"*Appl. Phys. Lett.* 81:280-282.

Koenig et al. (Jul. 5, 2004) "Drastic Enhancement of Nanoelectromechanical-System Fabrication Yield Using Electron-Beam Deposition," *Phys. Lett.* 85(1):157-159.

Koops et al. (Nov./Dec. 1996) "Conductive Dots, Wires, and Supertips for Field Electron Emitters Produced by Electron-Beam Induced Deposition on Samples Having Increased Temperature," *J. Vac. Sci. Technol. B* 14(6):4105-4109.

Koops et al. (Jan./Feb. 1988) "High-Resolution Electron-Beam Induced Deposition," *J. Vac. Sci. Technol. B* 6(1):477-481.

Kraus et al. (2000) "Nanomechanical Vibrating Wire Resonator for Phonon Spectroscopy in Liquid Helium," *Nanotechnol.* 11(3):165-168.

Liu et al. (2000) "Optically Excited Electron Emission from Silicon Filed Emitter Arrays," *Pacific Rim Conference on Lasers and Electro-Optics, CLEO-Technical Digest* pp. 352-353.

Molares et al. (Mar. 31, 2003) "Electrical Characterization of Electrochemically Grown Single Copper Nanowires," *Appl. Phys. Lett.* 82(13):2139-2141.

Nguyen, C.T.-C. (Aug. 1999) "Frequency-Selective MEMS for Miniaturized Low-Power Communication Devices," *IEEE Trans. Microwave Theory Tech.* 47(8):1486-1503.

Nojeh et al. (2006) "*Ab Initio* Modeling of the Interaction of Electron Beams and Single-Walled Carbon Nanotubes," *Phys. Rev. Lett.* 96:056802.

Pescini et al. (Dec. 3, 2001) "Nanoscale Lateral Field-Emission Triode Operating at Atmospheric Pressure," *Adv. Mater.* 13(23):1780-1783.

Pescini et al. (Jan. 20, 2003) "Mechanical Gating of Coupled Nanoelectromechanical Resonators Operating at Radio Frequency," *Appl. Phys. Lett.* 82(3):352-3354.

Pescini et al. (1999) "Suspending Highly Doped Silicon-on-Insulator Wires for Applications in Nanomechanics," *Nanotechnol.* 10:418-420.

Pescini, L. (May 8, 2003) "Electromechanical Coupling and Dissipation Mechanisms in Nanoscale Systems," Diploma Thesis, Ludwig-Maximilians-Universitat Munchen and Universitat degli Studi di Firenze.

Porter et al. (2001) "Laboratory Astrophysics Using an XRS Engineering Model Microcalorimeter," In; *Low Temperature Detectors*, 9$^{th}$ International Workshop on Low Temperature Detectors, AIP Conference Proceedings, 605.

Roukes, M.L. (2001) "Nanoelectromechanical Systems Face the Future," *Phys. World* 14:25-31.
Roukes et al. (2000) "Nanoelectromechanical Systems," *Technical Digest of the 2000 Solid-State Sensor and Actuator Workshop* Hilton Head Island, SC, Jun. 4-Jun. 8, 2000, pp. 1-10.
Scheible et al. (Jun. 7, 2004) "Silicon Nanopillars for Mechanical Single-Electron Transport," *Appl. Phys. Lett*. 84(23):4632-4634.
Scheible et al. (Sep. 2, 2002) "Evidence of a Nanomechanical Resonator Being Driven into Chaotic Response Via the Ruelle—Takens Route," *Appl. Phys. Lett*. 81(10):1884.
Scheible et al. (Aug. 1, 2004) "Effects of Low Attenuation in a Nanomechanical Electron Shuttle," *J. Appl. Phys*. 96(3):1757.
Scheible et al. (Oct. 25, 2004) "Periodic Field Emission from an Isolated Nanoscale Electron Island," *Phys. Rev. Lett*. 93(18):186801.
Scheible et al. (May 12, 2003) "Dynamic Control of Coupled Nano-Mechanical Resonators," *Appl. Phys. Lett*. 82(19):3333-3335.
Scheible et al. (2002) "Tunable Coupled Nanomechanical Resonators for Single-Electron Transport," *New J. Phys*. 4:86.1-86.7.
Schossler et al. (Mar./Apr. 1998) "Nanostructured Integrated Electron Source," *J. Vac. Sci Technol. B* 16(2):862-865.
Schossler et al. (Jul. Aug. 1997) "Conductive Supertips for Scanning Probe Applications," *J. Vac. Sci. Technol. B* 15(4):1535-1538.
Seamster et al. (1977) "Silicon Detector DeltaE-E Particle Identification: A Theoretically Based Analysis Algorithm and Remarks on the Fundamental Limits to the Resolution of Particle Type by DeltaE-E Measurements," *Nuc. Inst. Meth*. 145:583-591.
Smirnov et al. (2003) "Nonequilibrium Fluctuations and Decoherence in Nanomechanical Devices Coupled to the Tunnel Junction," *Phys. Rev. B* 67:115312.
Spindt et al. (May/Jun. 1996) "Field-Emitter-Array Development for Microwave Applications," *J. Vac. Sci. Technol. B* 14(3):1986-1989.
Spindt et al. (Mar./Apr. 1998) "Field Emitter Array Development for Microwave Applications. II," *J. Vac. Sci. Technol. B* 16(2):758-761.
Spindt, C.A. (Jun. 1968) "A Thin-Film Field-Emission Cathode," *J. Appl. Phys*. 39:3504-3505.
Stab, L. (1990) "Thin Epitaxial Silicon Detectors," *Nuc. Inst. Meth. A* 288:24-30.
Temple et al. (May/Jun. 1998) "Silicon Field Emitter Cathodes: Fabrication, Performance, and Applications," *J. Vac. Sci. Technol. A* 16(3):1980-1990.
Teo et al. (Oct. 13, 2005) "Microwave Devices: Carbon Nanotubes as Cold Cathodes," *Nature* 437:968.
Tilke et al. (May 26, 2003) "Fabrication and Transport Characterization of a Primary Thermometer Formed by Coulomb Islands in a Suspended Silicon Nanowire," *App. Phys. Lett*. 82(21):3773-3775.
Weber et al. (Mar./Apr. 1995) "Electron-Beam Induced Deposition for Fabrication of Vacuum Field Emitter Devices," *J. Vac. Sci. Technol. B* 13(2):461-464.
Whaley et al. (Jun. 2002) "Experimental Demonstration of an Emission-Gated Traveling-Wave Tube Amplifier," *IEEE TOPS* 30(3):998-1008.
Wilcock et al. (Feb. 6, 1960) "An Image Intensifier with Transmitted Secondary Electron Multiplication," *Nature* 185:370-371.
Wong et al. (1993) "Observational of Fowler-Nordheim Tunneling at Atmospheric Pressure Using Au/Ti Lateral Tunnel Diodes," *J. Phys. D* 26:979-985.
Xu et al. (Dec. 21, 1998) "Enhancing Electron Emission from Silicon Tip Arrays by Using Thin Amorphous Diamond Coating," *Appl. Phys. Lett*. 73(25):3668-3670.
Yamashita et al. (Nov./Dec.2000) "High-Performance Membrane Mask for Electron Projection Lithography," *J. Vac. Sci. Technol. B* 18(6):3237-3241.
Zheng et al. (Mar. 12, 2004) "Quantum-Mechanical Investigation of Field-Emission Mechanism of a Micrometer-Long Single-Walled Carbon Nanotube," *Phys. Rev. Lett*. 92(10)106803.

* cited by examiner

C

D

E

F

NANOPILLAR ARRAYS FOR ELECTRON EMISSION

CROSS-REFERENCE TO RELATED APPLICATIONS

This application claims the benefit of U.S. Provisional Patent Application 60/941,675 filed Jun. 3, 2007, which is hereby incorporated by reference in its entirety to the extent not inconsistent with the disclosure herein.

STATEMENT REGARDING FEDERALLY SPONSORED RESEARCH OR DEVELOPMENT

This invention was made with United States government support awarded by the following agencies: NIH HV028182. The United States government has certain rights in this invention.

BACKGROUND OF INVENTION

An electron multiplier is a common device component which uses secondary electron emission (SEE) to provide a gain in the intensity of incident radiation. In some device embodiments, for example, incident primary electrons pass a 'window' component of the device and scatter with a detector material capable of inducing a cascade of secondary electrons. By proper selection of the composition and physical state of the detector gain material, a gain is achieved when the yield of SEE is greater than one (i.e., on average more than one secondary electron is generated from each primary electron via inelastic scattering). In some detector schemes, for example, a plurality of electrodes capable of providing secondary electron emission, called dynodes, are provided in a stacked configuration. In these electron multiplier devices secondary electrons are generated upon interaction of radiation with a first dynode provided in the series. Secondary electrons from the first dynode are subsequently collected and accelerated toward subsequent dynodes provide in the series, wherein each dynode provides successive additional secondary electron emission. Secondary electron emission in these systems can be significantly enhanced using field emission (FE), wherein an electrical bias is provided to the system to facilitate extraction of the SEE generated. Electron multipliers are currently available that are capable of providing very significant gains functionality on the order of $10^5$ to $10^9$ for stack configurations.

Given their usefulness for amplifying electron signals, electron multiplier devices are key components in a range of systems including detectors, display devices and other high speed electronic systems. The application of electron multipliers for detector applications, for example, has led to the development of microchannel plate detector systems which are currently the most widely implemented detector platform for mass spectrometry. Wide spread use of these device components provides a motivation for the development of new materials and device configurations to improve the performance capabilities (e.g., gain, stability, lifetime etc.) and develop low cost fabrication pathways for electron multiplier devices.

Thin semiconductor membranes have been applied for quite some time as substrates for high-speed electronic devices, for display technology, as micromechanical devices such as pressure sensors, as mask materials for electron projection lithography, and as radiation detectors. These structures are particularly useful in device configurations wherein they provide a "window" for separating device components requiring specific, preselected operating conditions. In some detector systems, for example, semiconductor membranes provide a useful interface functionality for separating a detection environment from detector components that operate under vacuum and/or low temperatures conditions. Given the window functionality of thin semiconductor membranes, there is currently motivation to implement these device structures for a variety detector applications. The development of new semiconductor membrane structures capable of functioning as electron multiplier devices is expect to continue to enhance the utility of these structures in advanced detector systems.

A variety of semiconductors and semiconductor heterostructures are known to provide effective secondary electron emission upon exposure to radiation. Reducing the thickness of these materials to micron or submicron scales to achieve a semiconductor membrane configuration, however, substantially reduces secondary electron emission in many of these systems if the thickness corresponds to the inelastic mean free path of incident electrons. However, most common semiconductors have SEE yield below three, making it impractical to achieve a high gain be integrating multiple stacks. Providing some semiconductor materials in a semiconductor membrane configuration, for example, results in a complete loss of gain functionality. Hence, integrating a thin semiconductor membrane as a secondary electron emission element in a detector is currently not feasible for a range of important applications.

U.S. Pat. No. 4,060,823 provides electron emissive semiconductor devices consisting of separate regions of semiconductor materials spaced apart from each other by barrier device elements. Barriers for the disclosed electron emissive semiconductor devices include high resistance or insulating materials or alternatively p-n junctions capable of inhibiting or reducing current flow between the separated semiconductor regions. Device configurations using a thin membrane format are disclosed. The reference describes certain benefits achieved by the disclosed device configurations including protection against excessive electron emission currents, and a reduction in image spreading. Use of the electron emissive semiconductor devices as photocathodes and electron multipliers is disclosed.

U.S. Pat. Nos. 4,303,930, 5,138,402, and 5,814,832 describe semiconductor-based electron emitting devices having a multilayer configuration comprising a plurality of p-type and n-type doped semiconductor layers. In U.S. Pat. No. 4,303,930 the disclosed multilayer configuration has p-type semiconductor layers and n-type semiconductor layers integrated so as to generate a plurality of diode structures. Application of reverse bias voltage to the electrodes of the diode structures is reported to cause avalanche amplification and electron emission from the surface of the n-type layers. In U.S. Pat. No. 5,138,402, and 5,814,832 the disclosed multilayer configuration has a Schottky electrode and a p-type semiconductor layer, wherein electrons are emitted from the Schottky electrode in response to the application of reverse bias voltage. The disclosed multilayer structures are reported to provide stable device performance for a useful range of operating conditions.

It will be appreciated from the foregoing that electron emissive systems, such as electron multipliers and secondary electron emission systems, are needed for a range of applications including radiation detection, high speed electronics and display device applications. Particularly, thin semiconductor membrane-based electron emissive systems are needed that are capable of providing device interface functionality in addition to useful gain and bandwidth characteristics.

SUMMARY OF THE INVENTION

The present invention provides systems, devices, device components and structures for modulating the intensities and/or energies of electrons, including a beam of incident electrons. In some embodiments, for example, the present invention provides nano-structured semiconductor membrane structures capable of generating electron emission, including secondary electron emission and/or field emission. Nano-structured semiconductor membranes of some aspects of the present invention include membranes having an array of nanopillar structures capable of providing secondary electron emission and/or field emission for amplification, filtering and/or detection of incident radiation. Nano-structured semiconductor membranes of the present invention provide converters wherein interaction of incident primary electrons and nanopillars of the nanopillar array generates secondary electron emission and/or field emission. Nano-structured semiconductor membranes of an aspect of the present invention are also useful as directed charge amplifiers wherein secondary electron emission and/or field emission from a nanopillar array provides gain functionality for increasing the intensity of radiation comprising incident electrons.

The invention also provides electron sources, electron amplifiers, electron filters and electron detectors, and components thereof, comprising the present nano-structured semiconductor membrane structures. In some devices of this aspect of the present invention, nano-structured semiconductor membrane structures provide electron emission functionality, including secondary emission and/or field emission functionality. This aspect is useful for controlling, modulating and/or filtering the energies and/or intensities of radiation incident to, or generated within, devices and device components of the present invention. Nano-structured semiconductor membrane structures of devices of this aspect may optionally also provide device interface functionality wherein the semiconductor membrane provides a barrier, such as a window, between different components and/or regions of the present devices. This aspect is useful for accessing device configurations wherein different regions and/or components of the device are provided in different operating conditions (e.g., pressures, temperatures etc.). This aspect is useful for accessing device configurations wherein the nanostructure membrane provides an interface between an electron source or sampling region and components of a device provided at specific, preselected operating conditions, such as low pressure and/or low temperature conditions.

In an embodiment, the present invention provides an electron emission device comprising: (i) a semiconductor membrane having an external surface positioned to receive incident electrons from an electron source and an internal surface positioned opposite to the external surface, and (ii) an array of semiconductor nanopillars provided in electrical contact with the internal surface of the membrane. In some devices of this aspect of the present invention, the semiconductor membrane is at least partially transmissive to the incident electrons from the electron source; and electrons transmitted by the semiconductor membrane interact (e.g., scatter) with the nanopillars, thereby causing at least a portion of the nanopillars on the internal surface to emit electrons. In some embodiments, interaction of the incident electrons and the semiconductor membrane generates secondary electrons that are transmitted to the nanopillars on the internal surface, thereby causing the nanopillars to emit electrons. In some embodiment, the membrane is both partially transmissive to the incident electrons and capable of generating secondary electrons that are transmitted to the nanopillars provided on the internal surface. Selection of the physical dimensions (e.g., thickness) and composition of the semiconductor membrane determines, at least in part, if the membrane is transmissive to the incident electrons and/or if the membrane is capable of generating secondary electrons that subsequently interact with the nanopillars. As used throughput the present description, the expression "electron source" refers to a source of electrons, such as a source of primary electrons and/or a source of incident electrons.

In some embodiments, the semiconductor membrane of the present devices is in electrical contact with ground or near ground, or optionally at a reference voltage. Embodiments wherein the semiconductor membrane is maintained in contact with ground is useful for avoiding build up of electrical charge on the external and internal surfaces of the membrane and also provides an effective means of providing and replenishing electrons to the electron emission device.

Optionally, devices of this aspect of the present invention may further comprise an anode positioned close enough to the internal surface of the semiconductor membrane so as to establish a selected extraction voltage at the internal surface of the membrane. Useful anodes for the present electron emission devices include a faraday cup, grid electrode, disk electrode, and plate electrode. In some embodiments, for example, an anode is positioned and electrically biased so as to generate an extraction voltage at the internal surface of the membrane selected from the range of 50 V to 1000 V, and in some embodiments selected from the range of 50 V to 300 V. In some embodiments, an anode is positioned a distance from the internal surface of the semiconductor membrane selected from the range of 100 nanometers to 10000 microns. Incorporation of an anode in devices of the present invention is useful for enhancing the gain achieved in some electron emission devices of the present invention. The present invention includes devices, optionally having an anode device component, capable of realizing a gain selected from the range of $10^1$ to $10^6$, and in some embodiments from $10^1$ to $10^5$, and in some embodiments $10^1$ to $10^4$.

Semiconductor membranes useful in some specific devices and device components of the present invention have compositions and physical dimensions that provide at least partial transmission of incident electrons to the nanopillars provided in electrical contact with internal surface of the membrane. In some embodiments, the composition and thickness of the membrane is selected such that between 10% to 100% of the incident electrons are transmitted to the nanopillar array. The present invention also includes embodiments, however, wherein the semiconductor membrane is highly transmissive to primary incident electrons, for example, embodiments wherein the composition and thickness of the membrane is selected such that between 60% to 100% of the incident electrons are transmitted to the nanopillar array. In specific embodiments, semiconductor membranes in the present device have an average thickness selected from the range of 10 nanometers to 10 microns, and preferably for some applications selected from the range of 10 nanometers to 2.5 microns.

The physical dimensions and composition of semiconductor membranes of the invention may also be selected to provide other useful and important device capabilities and functionality of the present electron emission devices. In an embodiment, the thickness and composition of the semiconductor membrane is selected so as to provide an interface (or "window") between a primary electron source and/or sampling region and one or more device components of the device. The invention includes devices wherein the membrane has a composition and thickness allowing for a difference in pressure and/or temperature conditions between the primary electron source and/or sampling region and regions and/or device components of the device provided at low pressure (e.g., equal to or less than $1\times10^{-5}$ Torr) and/or low temperature operating conditions. In a specific embodiment, for example, the membrane allows for higher pressure conditions (e.g. pressure selected form the range $10^{-5}$ Torr to 1 bar) in a primary electron sampling region and lower pressure conditions (e.g., equal to or less than $1\times10^{-5}$ Torr) in one or more region(s) of the device separated from the sampling region by the semiconductor membrane, such as an electron amplification region and/or electron detection region. In an embodiment, the internal surface of the membrane is maintained at a pressure equal to or less than $1\times10^{-5}$ Torr. In an embodiment, the external surface of the membrane is maintained at a pressure selected from the range $10^{-5}$ Torr to $10^{-3}$ Torr.

In another embodiment, the semiconductor membrane has physical dimensions (e.g., length, width, diameter etc.) providing secondary electron emission and/or field emission and related devices (e.g., electron detectors, converters and amplifiers) having a large active area. In specific embodiments of this aspect, semiconductor membranes have an internal surface having a surface area selected from the range of 100 nanometer$^2$ to 5 cm$^2$ and preferably for some applications selected from the range of 10,000 nanometer$^2$ to 10,000 micron$^2$. In another embodiment, the semiconductor membrane has physical dimensions and a composition selected so as to enable a filtering functionality. In specific embodiments, for example, the membrane and nanopillar array functions as converter wherein substantially all (e.g., more than 70% and in some embodiments more than 90%) of the incident electrons are converted into secondary electrons, optionally having preselected energies. In another specific embodiment, the membrane and nanopillar array functions as a filter wherein secondary electrons and/or field emission are only generated upon interaction with primary incident electrons having energies within a preselected range of energies.

Selection of the composition, physical dimensions and spatial configuration of nanopillar elements of the nanopillar array in structures and devices of the present invention is important for accessing device functionality useful for a range of applications including electron amplification, conversion, filtering and detection. These device parameters can be selected, for example, to access a desired gain and/or bandpass for secondary electron emission from primary incident electrons. An advantage of the present electron emission devices is that the composition, physical dimensions and positions of nanopillars in the array can be deterministically preselected and precisely controlled using a variety of micro- and nano-fabrication techniques known in the art including but not limited to optical lithography (e.g., visible, ultraviolet and deep ultraviolet lithography), electron-beam lithography, laser ablation patterning, materials deposition (physical vapor deposition, chemical vapor deposition, atomic layer deposition, thermal deposition, sputtering deposition etc.), thermal oxidation processing, and materials removal (e.g., wet etching, dry etching etc.) methods. This capability of the present invention is beneficial as it allows electron emission devices to be tuned and/or optimize for specific applications by accurate and precise selection of nanopillar composition, physical dimensions (length, cross sectional dimensions etc.) and/or positions.

In the present invention, nanopillars may be provided in one or more arrays comprising between 1 to $10^8$ nanopillars. In some embodiments, the array has an average density of semiconductor nanopillars selected from the range of $1\times10^{-3}$ micron$^{-2}$ to about 250,000 micron$^{-2}$. Nanopillars of the present devices may be provided in one or more periodic nanopillar arrays (e.g., nanopillars are provided in a spatially periodic distribution), optionally having different pitch, different nanopillar dimensions and/or nanopillar compositions. The present invention includes embodiments wherein nanopillars are provided in one or more aperiodic arrays (e.g., nanopillars are provided in a spatially periodic distribution) or a plurality of periodic arrays having different spatial distributions (e.g., the pitch of nanopillars in the different arrays vary), different physical dimensions (e.g., length, cross sectional dimension) and/or different compositions. In this embodiment, different nanopillar arrays may provide different electron emission, electron amplification and/or different electron filtering properties.

In an embodiment, for example, a plurality of different nanopillar arrays are provided in electrical contact, and optional in physical contact, with the internal surface of the semiconductor membrane. The different nanopillar arrays in this embodiment may each have a different pitch, may comprise nanopillars having different physical dimensions (e.g., length and cross sections) and/or may comprise nanopillars with different compositions. Use of a device configuration comprising multiple arrays having different pitch, for example, is beneficial for devices of the present invention having a broad bandwidth because each array with a set of specific parameters (density, nanopillar dimensions, membrane thickness) is responsive/sensitive to incident electrons having different electron energies. These different arrays can be placed on the same membrane or on different membranes. Moreover, the membranes can be stacked to achieve bandwidth increase. The incorporation of a broad bandwidth ensures detection and amplification of electrons over a broad energy range. More specifically aperiodic arrays enable the creation of pass bands, i.e. electrons with a certain energy will be detected and the amount of charge amplified.

In an embodiment, semiconductor nanopillars of the present devices extend lengths along axes that intersect the internal surface of the membrane, wherein the lengths are selected from the range of 10 nanometers to 10 microns. In an embodiment, semiconductor nanopillars of the present devices have average cross sectional lengths, widths, or diameters selected from the range of 20 nanometers to 500 nanometers. In an embodiment, the semiconductor nanopillars of the present devices have aspect ratios selected from the range of 1 to $10^3$, and preferably for some applications selected from the range of 1 to 20. In some embodiments, semiconductor nanopillars of the present devices extend lengths along axes that intersect the internal surface of the membrane that are between 1 to 20 times the average thickness of the membrane. Nanopillars of the present invention may assume a wide variety of shapes. The invention includes, for example, semiconductor nanopillars having cross sectional shapes selected from the group consisting of a circle, square, rectangle, triangle, polygon, and ellipse, or any combination of these shapes. It is worth while noting that combining a membrane (two-dimensional device) with nanopillars (one-dimensional device) leads to a different physical result in some embodiments that is a more efficient detector. The dimension is obtained when the absolute scale of the membrane and the pillar sizes are compared to the mean free path of e.g. an electron with a certain incident energy within the material out of which the membrane and nanopillars are machined.

The pitch of nanopillars provided in a periodic array is another important parameter in devices of the present invention. In some embodiments, for example, the pitch of nanopillars in the array is tuned to provide a selected gain and/or bandpass of the present electron emission devices. The present invention includes, but is not limited to, devices wherein the average shortest distance between adjacent nanopillars in the array is selected from the range of 30 nanometers to 30 microns, and preferably for some applications selected from the range of 30 nanometers to 1 micron, and more preferably for some applications selected from the range of 30 nanometers to 500 nanometers.

Establishing electrical contact between nanopillars in the array and the semiconductor membrane is important in certain devices of the present invention. In some embodiments, electrical contact is established by providing the nanopillars in physical contact with the semiconductor membrane. Devices having a conformation wherein nanopillars are provided in physical contact with the semiconductor membrane is useful for providing good electron replenishment characteristics in the present emission devices. Alternatively, the present invention includes devices wherein nanopillars are provided in electrical contact via one or more conductive elements, including highly conductive elements and/or semiconductor elements, positioned between the nanopillars and the semiconductor membrane. The present invention also includes devices wherein the semiconductor membrane and the nanopillars comprise a, unitary structure. In the context of this description, a unitary structure refers to a configuration wherein the membrane and nanopillars comprise a single, continuous structure, optionally having a uniform composition.

Semiconductor membranes and nanopillars useful in specific device embodiments may comprise a variety of doped and undoped semiconductor materials including single crystalline semiconductors, polycrystalline semiconductors, doped diamond, and organic semiconductors. Semiconductor membranes and nanopillars may comprise the same or different semiconductor materials. Semiconductor membranes and nanopillars may comprise a single semiconductor material (doped or undoped), or alternatively may comprise a plurality of semiconductors materials and/or layers. Exemplary semiconductor materials include, but are not limited to, group IV semiconductors such as silicon, germanium and doped diamond, Group IV compound semiconductors, III-V semiconductors, III-V ternary semiconductor alloys, III-V quaternary semiconductor alloys, III-V quaternary semiconductor alloys, II-VI semiconductors, II-VI ternary alloy semiconductors, I-VII semiconductors, IV-VI semiconductors, IV-VI ternary semiconductors, V-VI semiconductors, II-V semiconductors or combinations of these. In an embodiment, the semiconductor membrane, nanopillar or both comprise a carbonaceous materials such as one or graphene or graphite layers (doped or undoped). In an embodiment, the semiconductor membrane, nanopillar or both comprise thin metallic layers and/or semiconductor membranes doped to the metallic limit. In an embodiment, the semiconductor membrane, nanopillar or both comprise SOI (Silicon-on-Insulator), SGOI (Silicon-Germanium-on-Insulator), or diamond. SOI and similar products (e.g. from SOITEC) are particularly attractive for some embodiments of the present invention as they can be obtained at low cost and are heavily used in the semiconductor industry.

The present invention includes devices wherein the membrane, the nanopillars or both are n-type doped semiconductors or p-type doped semiconductors. The present invention includes embodiments, wherein the membrane and nanopillars have the same doping. The present invention includes embodiments, wherein the membrane and nanopillars have graded doping. The present invention includes devices wherein the membrane and/or nanopillars have different doping, for example, embodiments wherein the membrane is a n-type doped semiconductor and the nanopillars are p-type doped semiconductors; or embodiments wherein the membrane is a p-type doped semiconductor and the nanopillars are n-type doped semiconductors. In specific embodiments, the membrane and/or the nanopillars form a plurality of p-n Junctions. In other embodiments, at least a portion of the nanopillars individually comprise p-n junctions.

Nanopillars useful in the present devices include semiconductor heterostructures an/or individual semiconductor devices. In an embodiment, for example, at least a portion of the nanopillars comprise a semiconductor heterostructure selected from the group consisting of a resonant tunneling diode, a quantum well, a light emitting diode, a laser and a field emissive structure. In an embodiment, one or more nanopillars of the array comprise a filed emissive device component, for example, a semiconductor base in electrical contact with a metallic field emitting tip. It is important to note that optionally the lasing or LED elements can be within the nano-pillars as well.

As discussed above, selection of the compositions, physical dimensions and/or positions of nanopillars in the array control, at least in part, the gain and/or bandwidth achieved in the present electron emission devices. In some embodiments, the electron emission devices of the present invention are capable of generating secondary electron emission for incident primary electrons having energies ranging from 1 keV to 200 keV.

Devices of this aspect may comprise an electron multiplier. Devices of this aspect may comprise an electron amplifier, wherein emission from the nanopillars is useful for increasing the intensity of incident primary electrons. In some embodiments, for example the yield of secondary electron emission from the nanopillars of the array is greater than 1 such that one average more than one secondary electron is generated by each primary electron. Devices of this aspect may comprise a primary electron converter, wherein at least a portion of primary incident electrons into secondary electrons emitted by the nanopillars. Optionally, converters of the present invention are capable of conversion of primary incident electrons. In some embodiment, for example, the converters of the present invention are capable of converting primary incident electrons into secondary emitted electrons having selected energies, a selected distribution of energies, a selected trajectory and/or a selected distribution of trajectories. Devices of this aspect may comprise a filter wherein primary incident electrons having specific preselected energies are selectively converted into secondary electrons emitted by the nanopillars and primary incident electrons not having specific preselected energies are not converted into secondary electrons emitted by the nanopillars. In an embodiment, the secondary electron emission device is capable of substantially preventing transmission of primary incident electrons (e.g., less than 10% of the primary incident electrons are converted).

The invention includes electron systems comprising a plurality of the above-described electron emission devices, for example provided in a stacked configuration. A "stacked configuration" refers to a plurality of electron emission devices provided in a series configuration wherein the output a preceding electron emission device in the series is provided as input to a subsequent electron emissive device. In an embodiment of this aspect, a plurality of the present electron emission devices are provided in a stacked series configuration. The first electron emission device in the series is positioned such that incident electrons from a source of electrons are incident up on its external surface, thereby resulting in generation of electrons emitted by the nanopillars of the first electron emission device in the series. A second electron emission device is positioned such that its external surface receives at least a portion of the electrons generated by the first electron emission device, thereby generating more emitted electrons. In this manner, the primary incident electrons are converted into a cascade of emitted electrons. This aspect of the present invention is particularly useful for devices and applications requiring large gain. Any number of additional electron emission devices may be incorporated into systems of the present invention, optionally provided in a stacked configuration. In an embodiment, the present invention provides a electron emission system comprising a stacked series of between 2 and 20 discrete electron emission devices, optionally provided in a stacked series configuration. It is important to note that individual electron emission devices in the series may have the same or different nanopillar compositions, physical dimensions and positions, array pitch and/or semiconductor membranes having the same or different compositions and physical dimensions. In an embodiment, for example, electron emission devices are provided in a stacked series configuration wherein the pitch of nanopillar arrays decreases from the first electron emission device in the series to subsequent electron emission devices in the series, for example optionally decreasing from first to second electron emission devices; optionally decreasing from second to third electron emission devices, optionally decreasing from third to fourth electron emission devices, and so forth. Use of a stack series configuration with nanopillar arrays having pitch that decreases with the position in the stacked series is useful for converting high energy incident primary electrons to lower energy electrons, for example by slowing the electrons down as they pass through and are generating in the stacked series. In an embodiment, a electron emission device is provided in a stack series configuration wherein the first electron emission device in the series has a nanopillar array pitch selected from the range of 400 to 600 nanometers, the second electron emission device in the series has a nanopillar array pitch selected from the range of 300 to 500 nanometers and the third electron emission device in the series has a nanopillar array pitch selected from the range of 200 to 400 nanometers.

In another aspect, the invention provides detectors and detection systems comprising one or more of the present electron emission devices and an electron detector positioned to detect at least a portion of electrons emitted by the nanopillars of one or more of the electron emission devices. Useful electron detectors in embodiments of this aspect include, but are not limited to, a faraday cup, a microchannel plate, an electron multiplier, a phosphorescent screen or combinations of these. As discussed above in the context of electron emission device, detectors and detector systems of the present invention may further comprises additional device elements. In an embodiment, for example, the detector or detection system further comprise an anode, such as a grid, ring or plate electrode positioned between the internal surface of the membrane and the electron detector. Anodes useful in these embodiments optionally are positioned and electrically biased so as to generate an extraction voltage at the internal surface of the membrane selected from the range of 50 V to 300 V.

The present electron emission systems are particularly useful for providing a booster stage for a microchannel plate (MCP) device and/or MCP detector. Electron emission systems of the present invention also provide a detector with pixels possessing sensitivity at different energies. Other applications of the present electron emission systems include a streak detector, and a primary detector element. The electron emissive systems of the present invention may be integrated with other electronic and/or electro-optic devices, device components and structures. The present invention includes a combination of electron detection with TFT (thin film transistor) device for example for Direct Display Detection applications.

In another aspect, the present invention provides a system for generating electrons comprising: (i) an electron source for generating incident electrons; (ii) a semiconductor membrane having an external surface positioned to receive the incident electrons from the electron source and an internal surface positioned opposite to the external surface; wherein the semiconductor membrane is at least partially transmissive to the incident electrons or is capable of generating secondary electrons or other charged particles from the incident electrons; and (iii) an array of semiconductor nanopillars provided in electrical contact with the internal surface, wherein electrons or other charged particles transmitted or generated by the semiconductor membrane cause at least a portion of the nanopillars on the internal surface to emit electrons, thereby generating electrons. Optionally, the semiconductor membrane of this system is connected to ground or near ground, or a reference voltage. Optionally, incident electrons provided to the external surface of the semiconductor membrane have energies ranging from 1 keV to 100 keV. Optionally, incident electrons provided to the external surface of the semiconductor membrane have an intensity ranging from 10 pA to 10 nA. Optionally, the system comprises an anode positioned close enough to the internal surface of the semiconductor membrane so as to establish a selected extraction voltage at the internal surface of the membrane, for example extraction voltage at the internal surface of the membrane selected from the range of 50 V to 1000 V. In an embodiment, the anode is at least partially transmissive to the electrons emitted by the nanopillars. In an embodiment, the anode is a grid electrode or faraday cup. In an embodiment, the internal surface or the membrane is maintained at a pressure equal to or less than $1\times10^{-5}$ Torr.

In an embodiment, an electron emission device of the present invention comprises an amplifier for increasing the intensity of incident primary electrons from the electron source. In an embodiment, an electron emission device of the present invention comprises a converter for converting at least a portion of the incident primary electrons from the electron source into secondary electrons emitted by the nanopillars.

In an embodiment, the present invention provides a detection system for detecting incident electrons comprising: (i) a semiconductor membrane having an external surface positioned to receive the incident electrons and an internal surface positioned opposite to the external surface; wherein the semiconductor membrane is at least partially transmissive to the incident electrons or is capable of generating secondary electrons or other charged particles from the incident electrons; and (ii) an array of semiconductor nanopillars provided in electrical contact with the internal surface, wherein electrons or other charged particles transmitted or generated by the semiconductor membrane cause at least a portion of the nanopillars on the internal surface to emit electrons; and (iii) an electron detector positioned to detect at least a portion of the electrons emitted by the nanopillars on the internal surface. In an embodiment, the detection system further comprises an anode positioned between the internal surface of the semiconductor membrane and the detector. In an embodiment, the anode is positioned close enough to the internal surface of the semiconductor membrane so as to establish a selected extraction voltage at the internal surface of the membrane. In an embodiment, the extraction voltage at the internal surface of the membrane is selected from the range of 50 V to 1000 V. In an embodiment, the anode is at least partially transmissive to the electrons emitted by the nanopillars. In an embodiment, the anode is a grid electrode or faraday cup. In an embodiment, the membrane is connected to ground. In an embodiment, the detector is selected from the group consisting of a Faraday cup, a microchannel plate, an electron multiplier, and phosphorescent screen. In an embodiment, the internal surface or the membrane is maintained at a pressure equal to or less than $1\times10^{-5}$ Torr.

In another aspect, the present invention provides a electronic device comprising: a plurality of electron emission devices; wherein each of the electron emission devices comprises: a semiconductor membrane having an external surface positioned to receive incident electrons and an internal surface positioned opposite to the external surface; wherein the semiconductor membrane is at least partially transmissive to the incident electrons or is capable of generating secondary electrons or other charged particles from the incident electrons; and an array of semiconductor nanopillars provided in electrical contact with the internal surface, wherein electrons or other charged particles transmitted or generated by the semiconductor membrane cause at least a portion of the nanopillars on the internal surface to emit electrons; wherein the plurality of electron emission devices are provided in a series configuration, such that a first electron emission device is positioned to receive incident electrons from an electron source, thereby generating emitted electrons from the first electron emission device, and wherein a second electron emission device is positioned to receive at least a portion of the electrons emitted the first electron emission device, thereby generating emitted electrons from the second electron emission device. In an embodiment, the array of the first electron emission device has an average density of semiconductor nanopillars larger than that of the array of the second electron emission device. In an embodiment, the nanopillars of the array of the first electron emission device have average cross sectional dimensions greater than that of the nanopillars of the second array of the first electron emission device. In an embodiment, the nanopillars of the array of the first electron emission device have average lengths greater than that of the nanopillars of the second array of the first electron emission device. In an embodiment, the electronic device further comprises additional electron emission devices provided in the series configuration. In an embodiment, the electronic device comprises 1 to 20 of the additional electron emission devices.

In another aspect, the present invention provides a method for increasing the intensity of incident electrons from an electron source comprising the steps: (i) providing an electron amplifier comprising: (1) a semiconductor membrane having an external surface positioned to receive the incident electrons from the electron source and an internal surface positioned opposite to the external surface; wherein the semiconductor membrane is at least partially transmissive to the incident electrons or is capable of generating secondary electrons or other charged particles from the incident electrons; and (2) an array of semiconductor nanopillars provided in electrical contact with the internal surface; and (ii) exposing the electron amplifier to the incident electrons, wherein electrons or other charged particles transmitted or generated by the semiconductor membrane cause at least a portion of the nanopillars on the internal surface to emit electrons, thereby increasing the intensity of incident electrons from an electron source. In an embodiment, a method of the present invention further comprises the step of providing the membrane at ground. In an embodiment, a method of the present invention further comprises the step of maintaining the internal surface of the membrane at a pressure equal to or less than $1\times10^{\times5}$ Torr.

In an embodiment, the present invention provides a method for detecting incident electrons comprising the steps: (i) providing a detector comprising: (1) a semiconductor membrane having an external surface positioned to receive the incident electrons and an internal surface positioned opposite to the external surface; wherein the semiconductor membrane is at least partially transmissive to the incident electrons or is capable of generating secondary electrons or other charged particles from the incident electrons; and (2) an array of semiconductor nanopillars provided in electrical contact with the internal surface, wherein electrons or other charged particles transmitted or generated by the semiconductor membrane cause at least a portion of the nanopillars on the internal surface to emit electrons; and (3) an electron detector positioned to detect electrons emitted by the nanopillars; and (ii) exposing the detector to the incident electrons; and (iii) detecting at least a portion of the electrons emitted by the nanopillars on the internal surface of the membrane, thereby detecting incident electrons. In an embodiment, a method of the present invention further comprises the step of providing the membrane at ground. In an embodiment, a method of the present invention further comprises the step of maintaining the internal surface of the membrane at a pressure equal to or less than $1\times10^{-5}$ Torr.

In another embodiment, the present invention provides a method for generating electrons; the method comprising the steps: (i) providing an electron source for generating incident electrons; (ii) providing a semiconductor membrane having an external surface positioned to receive the incident electrons from the electron source and an internal surface positioned opposite to the external surface; wherein the semiconductor membrane is at least partially transmissive to the incident electrons or is capable of generating secondary electrons or other charged particles from the incident electrons; and (iii) providing an array of semiconductor nanopillars in electrical contact with the internal surface, wherein electrons or other charged particles transmitted or generated by the semiconductor membrane cause at least a portion of the nanopillars on the internal surface to emit electrons, thereby generating electrons. In an embodiment, a method of the present invention further comprises the step of providing the membrane at ground. In an embodiment, a method of the present invention further comprises the step of maintaining the internal surface of the membrane at a pressure equal to or less than $1\times10^{-5}$ Torr.

BRIEF DESCRIPTION OF THE DRAWINGS

FIGS. 8*a*-8*b* provide measurements of the current detected upon exposure of the semiconductor membrane to secondary electrons from the copper reflector. FIG. 8(*b*) shows the pure field emission current by subtracting the secondary electron emission current. FIG. 8(*c*) shows the Fowler-Nordheim presentation of field emission.

DETAILED DESCRIPTION OF THE INVENTION

Figure 1A:
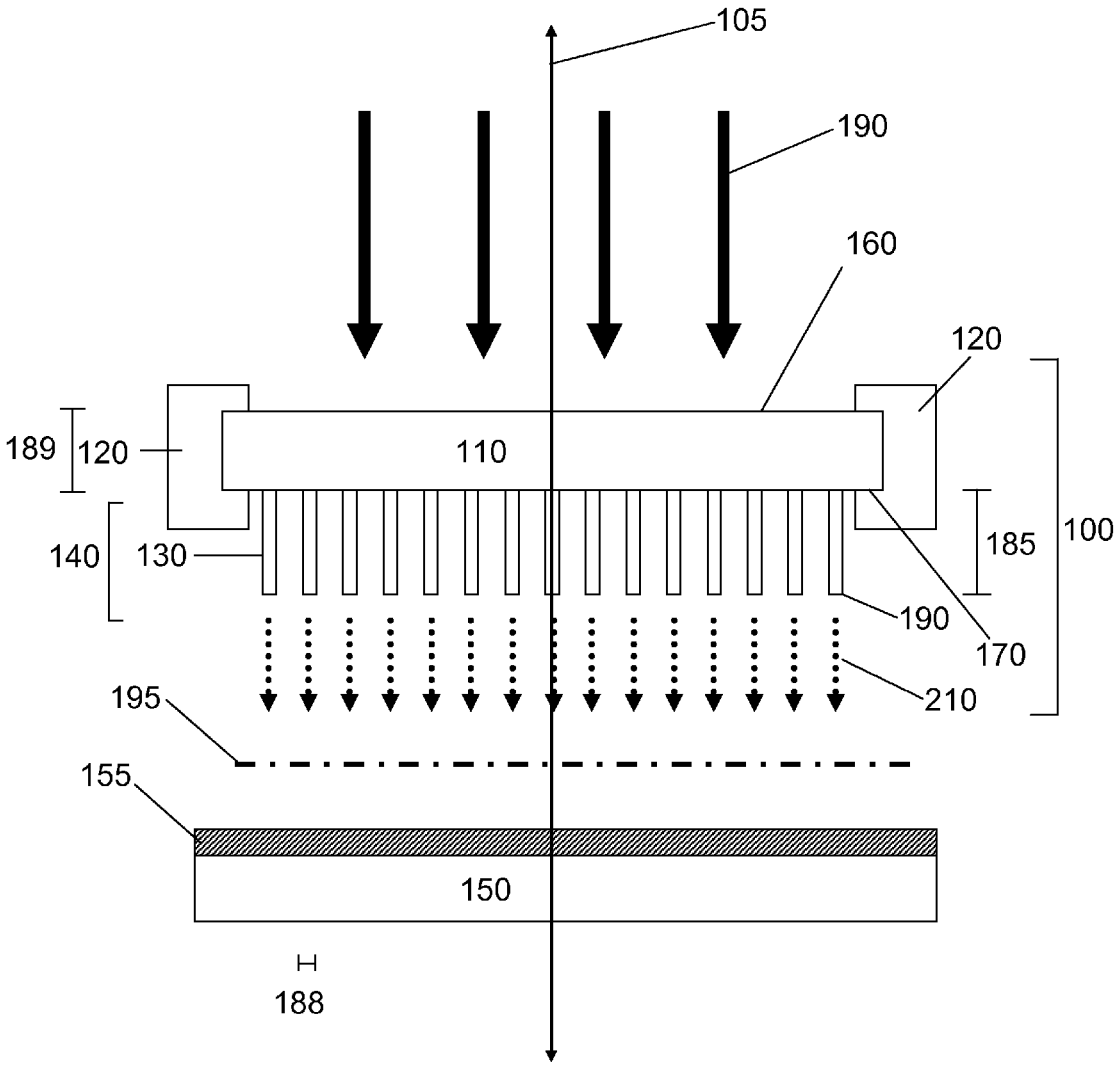
FIG. 1A provides a cross sectional view of a device of the present invention comprising a nano-structured semiconductor membrane structure.

Referring to the drawings, like numerals indicate like elements and the same number appearing in more than one drawing refers to the same element. In addition, hereinafter, the following definitions apply:

"Membrane" refers to a device component, such as a thin structural element. Membranes of the present invention functions to support an array of nanopillars and transmit at least a portion of radiation incident to an external surface of the membrane to at least a portion of the nanopillars. Optionally, membranes of the present invention may function as an interface for separating components of a device and/or separating an electron source or sampling regions from device components. Semiconductor membranes useful in the present invention may comprise a wide range of additional materials including dielectric materials, ceramics, polymeric materials, glasses and metals.

"Active area" refers to the area of a external surface of surface a secondary electron emission system of the present invention of an that is capable of receiving radiation and generating secondary emission.

"Nanopillar" refers to a structure having at least one cross sectional dimension (e.g. diameter, radius, width, thickness etc.) selected form the range of 1 nanometer to 1000 nanometers. Nanopillars in an array extend lengths that are spaced apart from each other and have features/portions that are not in physical contact with each other or other device components. In some embodiments, nanopillars in a nanopillar array do not physically contact each other. In other embodiments nanopillars in a nanopillar array contact adjacent nanopillars via base regions proximate to the internal surface of the semiconductor membrane. Nanopillars of the present invention are separated from each other by voids that may optionally be occupied by one or more gases having selected partial pressure or may optionally be at low pressure (e.g., less than $1\times10^{-5}$)

"Pitch" in the context of a nanopillar array is a characterization of the distance between two adjacent nanopillars in a nanopillar array. In some embodiments, pitch is defined as the distance from the center of a first nanopillar and the center of a second nanopillar adjacent to the first nanopillar. In some embodiments, pitch is defined as the width of a nanopillar plus the shortest distance to an adjacent nanopillar in an array.

"Semiconductor" refers to any material that is a material that is an insulator at a very low temperature, but which has an appreciable electrical conductivity at a temperature of about 300 Kelvin. In the present description, use of the term semiconductor is intended to be consistent with use of this term in the art of microelectronics and electrical devices. Semiconductors useful in the present invention may comprise element semiconductors, such as silicon, germanium and doped diamond, and compound semiconductors, such as group IV compound semiconductors such as SiC and SiGe, group III-V semiconductors such as AlSb, AlAs, AlN, AlP, BN, GaSb, GaAs, GaN, GaP, InSb, InAs, InN, and InP, group III-V ternary semiconductors alloys such as $Al_xGa_{1-x}As$, group II-VI semiconductors such as CsSe, CdS, CdTe, ZnO, ZnSe, ZnS, and ZnTe, group I-VII semiconductors CuCl, group IV-VI semiconductors such as PbS, PbTe and SnS, layer semiconductors such as $PbI_2$, $MoS_2$ and GaSe, oxide semiconductors such as CuO and $Cu_2O$. The term semiconductor includes intrinsic semiconductors and extrinsic semiconductors that are doped with one or more selected materials, including semiconductor having p-type doping materials and n-type doping materials, to provide beneficial electrical properties useful for a given application or device. The term semiconductor includes composite materials comprising a mixture of semiconductors and/or dopants. Specific semiconductor materials useful for in some applications of the present invention include, but are not limited to, Si, Ge, SiC, AlP, AlAs, AlSb, GaN, GaP, GaAs, GaSb, InP, InAs, GaSb, InP, InAs, InSb, ZnO, ZnSe, ZnTe, CdS, CdSe, ZnSe, ZnTe, CdS, CdSe, CdTe, HgS, PbS, PbSe, PbTe, AlGaAs, AlInAs, AlInP, GaAsP, GaInAs, GaInP, AlGaAsSb, AlGaInP, and GaInAsP.

"Electrical contact" refers to the configuration of two or more elements such that a charged element, such as an electron, is capable of migrating from one element to another. Accordingly, electrical contact encompasses elements that are in "physical contact." Elements are in physical contact when they are observable as touching. Electrical contact also includes elements that may not be in direct physical contact, but instead may instead have an connecting element, such as an conductive or semiconductive material or structure, located between the two or more elements.

As used herein, the term "array" refers to an ordered arrangement of structural elements, such as an ordered arrangement of individually addressed and spatially localized nanopillars. The present invention includes periodic arrays of nanopillars wherein nanopillars of the array are positioned at regular intervals (i.e. the distance between adjacent nanopillars measured from their centers is within 10% of the average distance between adjacent nanopillars in the array measured from their centers). In some embodiments, nanopillars in a periodic array are positioned such that the equidistant from adjacent nanopillars in the array. In some embodiments, nanopillars in a periodic array are positioned such that they have a substantially constant pitch (e.g., constant within about 90%). The present invention also include embodiments wherein multiple periodic arrays having the same or different pitch, nanopillar physical dimensions and/or nanopillar compositions are provided in electrical contact, and optionally in physical contact, with the internal surface of the semiconductor membrane. The present invention also includes aperiodic arrays of nanopillars wherein nanopillar are positioned in the array at not regular intervals.

In the following description, numerous specific details of the devices, device components and methods of the present invention are set forth in order to provide a thorough explanation of the precise nature of the invention. It will be apparent, however, to those of skill in the art that the invention can be practiced without these specific details.

FIG. 1A provides a cross sectional view of a secondary electron emission device of the present invention comprising a nano-structured semiconductor membrane structure. Secondary electron emission device 100 comprises thin semiconductor membrane 110 having a external surface 160 and an internal surface 170. As also shown in FIG. 1A, secondary electron emission device 100 further comprises array 140 of nanopillars 130 extending lengths 185 that are parallel to the alignment axis 105 which intersects internal surface 170 of the semiconductor membrane 110. Nanopillars 130 of array 140 have a least one cross sectional dimension (schematically illustrated as drawing element 188) that is less than about 1 micron. Nanopillars 130 of array 140 are provided in electrical contact with semiconductor membrane 110, and in the specific embodiment shown in FIG. 1A nanopillars 130 of array 140 are provided in physical contact with semiconductor membrane 110. Alternatively, semiconductor membrane 110 and Nanopillars 130 may comprise a unitary structure. Optionally, semiconductor membrane 110 is supported by one or more frame elements 120 capable of positioning the semiconductor membrane 110 in a desired spatial orientation for a given device configuration or application.

Figure 1B:
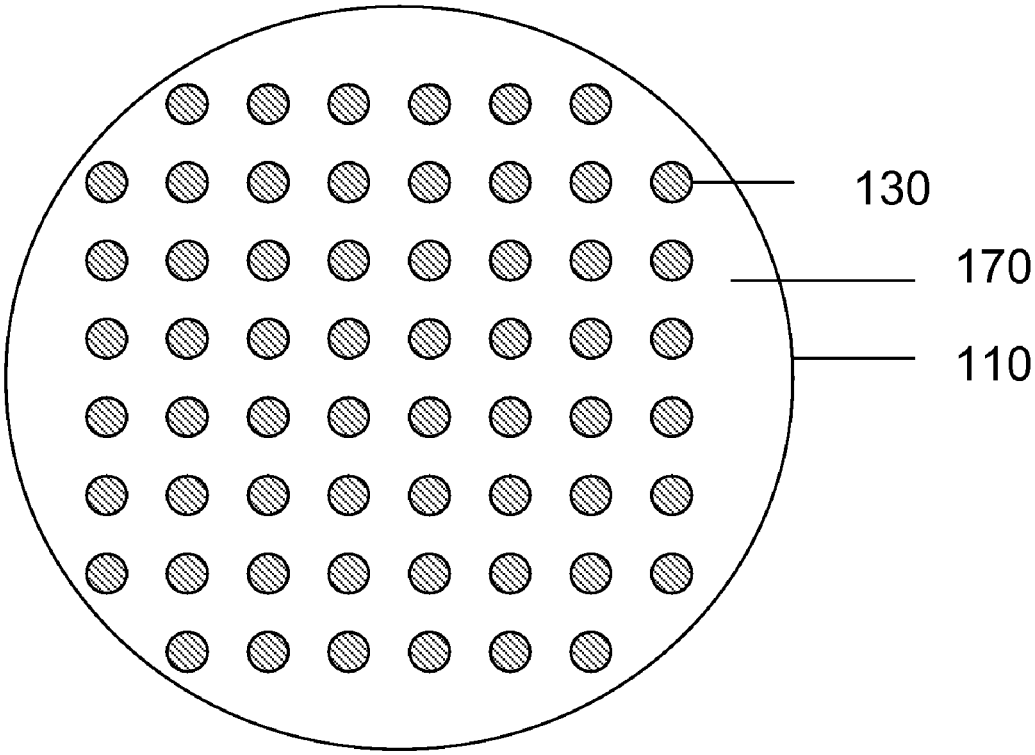
FIG. 1B provides a bottom plan view of a device of the present invention comprising a nano-structured semiconductor membrane structure indicating nanopillars, internal surface and semiconductor membrane.

FIG. 1B provides a bottom plan view of a device of the present invention comprising a nano-structured semiconductor membrane structure indicating nanopillars 130, internal surface 170 and semiconductor membrane 110.

As mentioned throughout this description, the lengths 185, cross sectional dimensions 188 and positions of nanopillars 130 of array 140 are selected so as to provide a desired functionality (gain, bandwidth, interface functionality etc.) and/or device performance plication. Further, thickness 189 of semiconductor membrane 110 is another useful parameter that is selected so as to access a desired functionality (gain, bandwidth, interface functionality etc.) and/or device performance. As shown in FIGS. 1A and 1B, nanopillar array of this configuration are not in physical contact with each other. As shown in FIGS. 1A and 1B, nanopillars 130 in the array are separate from adjacent nanopillars by voids regions. The configuration wherein nanopillar are separated from each other by void regions (i.e., not in physical contact) is important in some embodiments for providing gain functionality. In some embodiments, the space between adjacent nanopillars is occupied by a gas, liquid, solid or gel. In some embodiments, for example, the space between adjacent nanopillars is occupied by one or more photosensitive and/or photoactive material, for example to control the dielectric constant in these regions.

As shown in FIG. 1A, primary incident electrons (schematically shown as arrows 190) are provided to external surface 160 of semiconductor membrane 110. At least a portion of the primary incident electrons are transmitted through semiconductor membrane 110 and interacted with nanopillars 130 of array 140, thereby resulting in generation of secondary electrons (schematically shown as arrows 210) emitted by nanopillars 130 of array 140.

Optionally, secondary electron emission device 100 may further comprise anode 195 positioned proximate to internal surface 170 of semiconductor membrane 110. In some embodiments, anode 195 positioned close enough to internal surface 170 of semiconductor membrane 110 so as to provide a selected extraction voltage at internal surface 170 of semiconductor membrane 110. Optionally, anode 195 positioned proximate to internal surface 170 of semiconductor membrane 110 comprises a grid electrode or faraday cup. In an embodiment, the anode 195 is provided a distance from the internal surface 170 of semiconductor membrane 110 selected from the range of 100 nanometers to 1000 microns.

Optionally, devices of the present invention may further comprises an electron detector 150 having sensing surface 155 positioned to receive secondary electrons (schematically shown as arrows 210) emitted by nanopillars 130 of array 140. As shown in FIG. 1A, the present invention includes device configurations wherein anode 195 is positioned between internal surface 170 of semiconductor membrane 110 and sensing surface 155 of detector 150. Incorporation of electron detector 150 is useful in detectors and detection systems of the present invention.

Figure 1C:
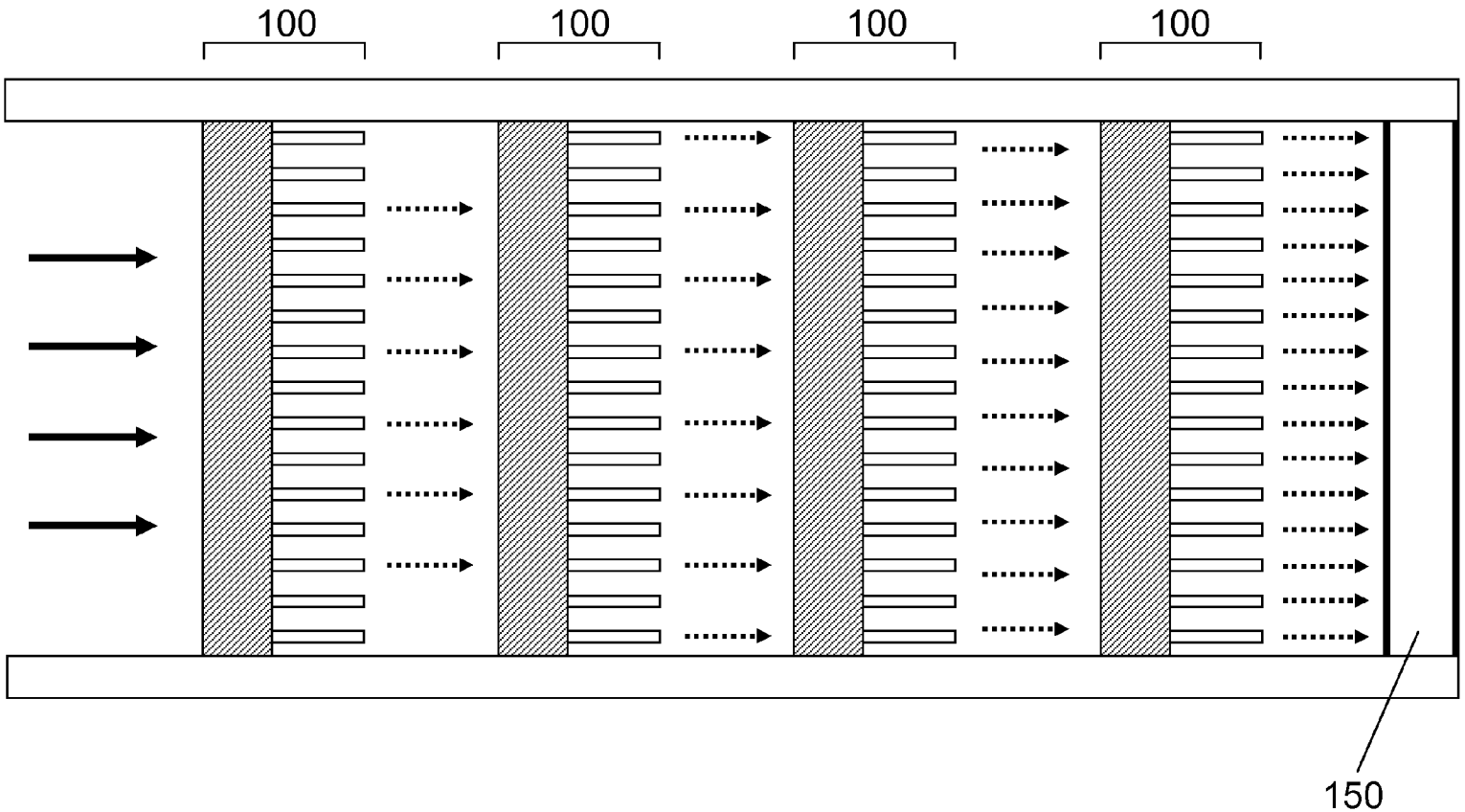
FIG. 1C provides a schematic diagram of a electron emission system comprising a plurality of the electron emission devices shown in FIGS. 1A and 1B.

FIG. 1C provides a schematic diagram of a secondary electron emission system comprising a plurality of the secondary electron emission devices shown in FIGS. 1A and 1B. As shown in this Figure, secondary electron emission devices 100 are provided in a stacked series configuration. In this embodiment, secondary emission generated from a first secondary electron emission device 100 in the series is provided to subsequent secondary electron emission devices 100 resulting in a cascade of secondary emission from electron emission devices 100 in the system. The system shown in FIG. 1C functions as an electron multiplier and/or amplifier providing gain functionality. The system in FIG. 1C optionally further comprises detector 150 positing to receive at least a portion of the secondary emission generated by the electron emission devices 100 in the system. Individual biasing of semiconductor membranes in devices of the present invention comprising a plurality of emission devices provided in a stacked configuration provides an effective means of establishing the overall biasing of these systems.

Figure 1D:
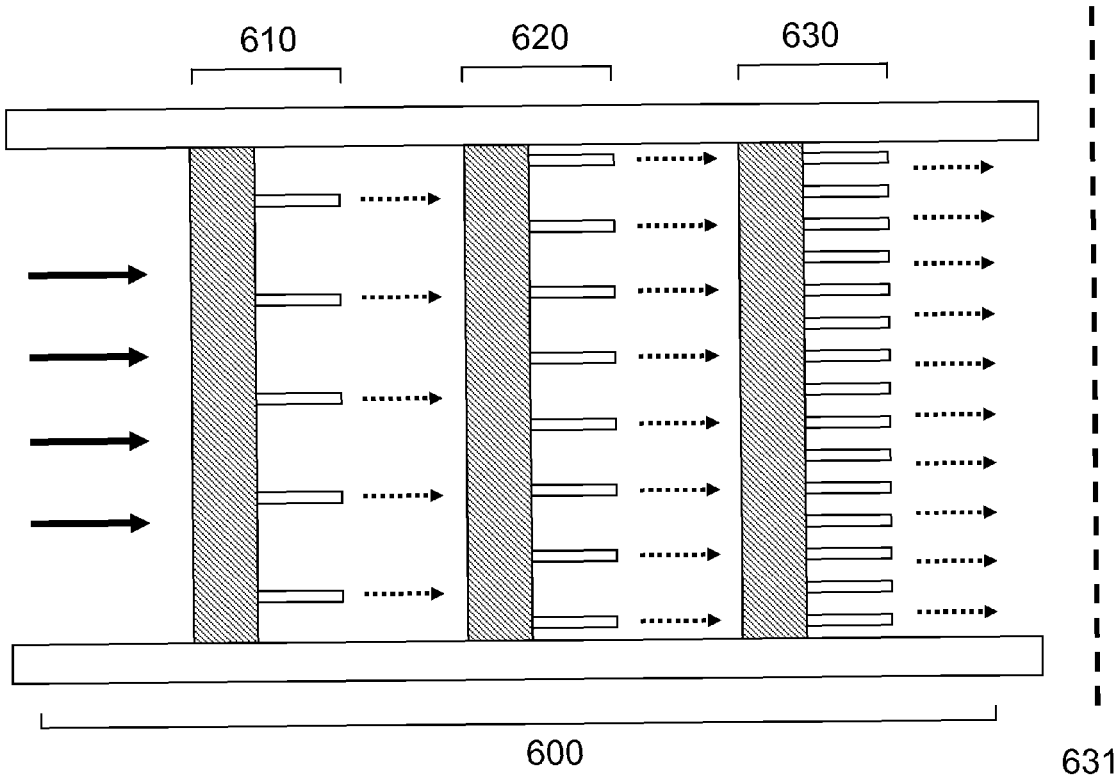
FIG. 1D provides a schematic diagram of a electron emission system comprising a plurality of electron emission devices provided in a stack series configuration, wherein the pitch of nanopillar arrays in the electron emission devices varies with position in the stacked series.

FIG. 1D provides a schematic diagram of a cross sectional view of a secondary electron emission system comprising a plurality of secondary electron emission devices provided in a stack series configuration, wherein the pitch of nanopillar arrays in the secondary electron emission devices varies with position in the stacked series. The secondary electron emission system 600 comprises a first secondary electron emission device 610, a second secondary electron emission device 620 and a third secondary electron emission device 630. As shown in FIG. 1D, the first secondary electron emission device 610 has a nanopillar array with a larger pitch than the nanopillar array of the second secondary electron emission device 620 in the stacked series. In addition, the second secondary electron emission device 620 has a nanopillar array with a larger pitch than the nanopillar array of the third secondary electron emission device 630 in the stacked series. In FIG. 1D, primary incident electrons are schematically represented by solid arrows and secondary emitted electrons are schematically represented by dotted arrows. The configuration in FIG. 1D is particularly useful for converting primary electrons having high energies into secondary emitted electrons having lower energies, for example for converting primary electrons into secondary emitted electrons having a selected energy distribution that is lower in energy than the energy distribution of the primary electrons. Optionally, secondary electron emission system 600 further comprises the anode 631.

Figure 1E:
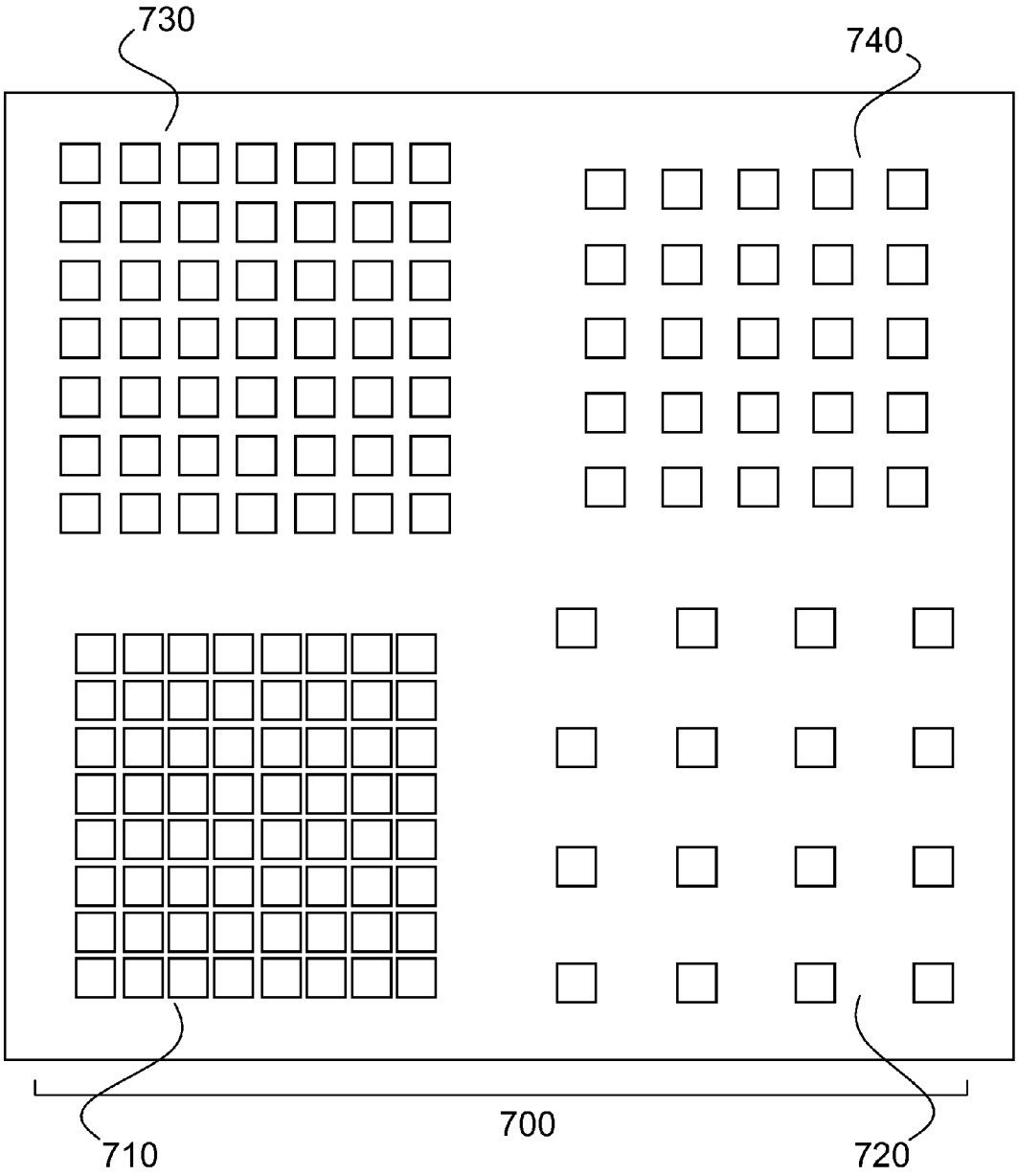
FIG. 1E provides a schematic diagram of a bottom plan view of a electron emission device of the present invention wherein a plurality of different nanopillar arrays are provided in electrical contact, and optionally in physical contact, with the internal surface of the semiconductor membrane.

FIG. 1E provides a schematic diagram of a bottom plan view of a secondary electron emission device of the present invention wherein a plurality of different nanopillar arrays are provided in electrical contact, and optionally in physical contact, with the internal surface of the semiconductor membrane. The secondary electron emission device 700 comprises a first nanopillar array 720, a second nanopillar array 740, a third nanopillar array 730 and a fourth nanopillar array 710, all of which are provided in electrical contact with the internal surface of a single semiconductor membrane of the device. Each of the first, second, third and fourth nanopillar arrays have a different pitch. As shown in FIG. 1E, the pitch of first nanopillar array 720 is larger than the pitch of second nanopillar array 740, the pitch of second nanopillar array 740 is larger than the pitch of third nanopillar array 730 and the pitch of third nanopillar array 730 is larger than the pitch of second nanopillar array 710. Incorporation of a plurality of nanopillar arrays each having a different pitch into devices of the present invention provides for electron emission capability over a wide bandwidth, as each nanopillar array in the device may be responsive to (i.e., generate secondary emission) a different range of incident electron energies.

The devices and systems shown in FIGS. 1A, 1B, 1C,1F and 1E optionally function as means of converting primary incident electrons to secondary emitted electrons. The devices and systems shown in FIGS. 1A, 1B, 1C,1F and 1E optionally functions as means of converting incident electrons having a first energy distribution to secondary emitted electrons having a second energy distribution different from the first energy distribution, for example a second energy distribution that is less than that of the first energy distribution. The devices and systems shown in FIGS. 1A, 1B, 1C,1F and 1E optionally functions as filter for converting and/or amplifying incident electrons having selected energies or energy distributions.

Example 1

Nanopillar Arrays on Semiconductor Membranes Amplify Electron Emission

The present invention provides secondary electron emission devices useful for modulating incident radiation. To evaluate capability of devices of the present invention for generating secondary electron emission, a secondary electron emission device comprising a semiconductor membrane having a nanopillar array was fabricated and exposed to a beam of incident electrons. In this Example experimental results are provided relating to nano-structured single-crystal silicon membranes as the basic element for a new class of active thin-membrane detectors. This integrates the required 'window' with the actual detector and thus creates a detector window with gain. As described in this Example, we found that patterning a two-dimensional (2D) membrane with a regular array of one-dimensional (1D) nanopillars strongly enhances SEE generation enabling important applications such as a directed charge amplifier. Further, the results provided herein indicate that the combination of materials with different dimensions (2D+1D) leads to phenomena, which are different from the expected three-dimensional (3D) behavior.

Figure 2:
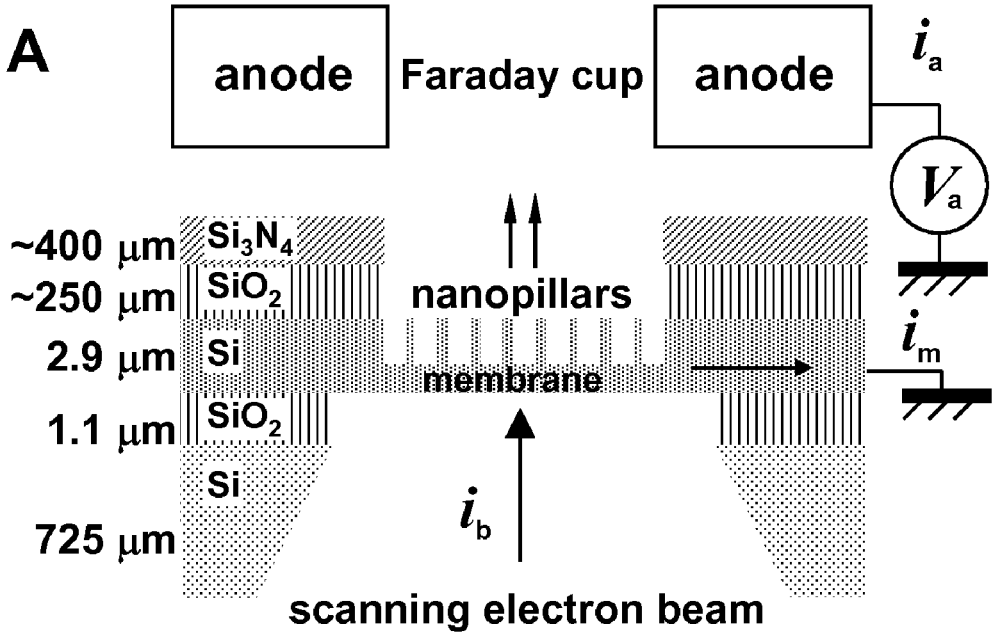
FIG. 2. Probing electron emission through a nanopillar-membrane system. (a) Schematic of the experimental setup in a scanning electron microscope. The device is a thin silicon membrane with an array of nanopillars fabricated on the top side. A Faraday-cup anode with voltage $V_a$ is placed above the nanopillars. Electron emission current $I_a$ from the nanopillars is probed by the anode when the electron beam with beam current $I_b$ scans the membrane on the back side. (b), (c), (d), and (e) are scanning electron micrographs. (b) Top view of four square membranes (35×35 $\mu m^2$) with nanopillars patterned as a 'frame' on the membranes. The center squares of 14×14 $\mu m^2$ contain no nanopillars, while there are about 17,600 nanopillars in each 'frame'. Three distinct areas are marked by B as bulk areas with an unprocessed SOI layer and two layers of insulators, M as thinned membrane, and Δ as the nanopillar-membrane area. (c) and (d) are close views of a nanopillar array. Each nanopillar has a diameter of about 80 nm with the base slightly wider, the height is about 300 nm. Nanopillars are patterned into a square lattice with a pitch of 200 nm. (e) A scanning electron micrograph shows the cross section of the membrane. (f) A Monte-Carlo simulation shows the different distributions of incident primary electrons (blue dots) penetrating from beneath and secondary electrons (red color) in the membrane-nanopillar structure (see text for details).
Figure 2:
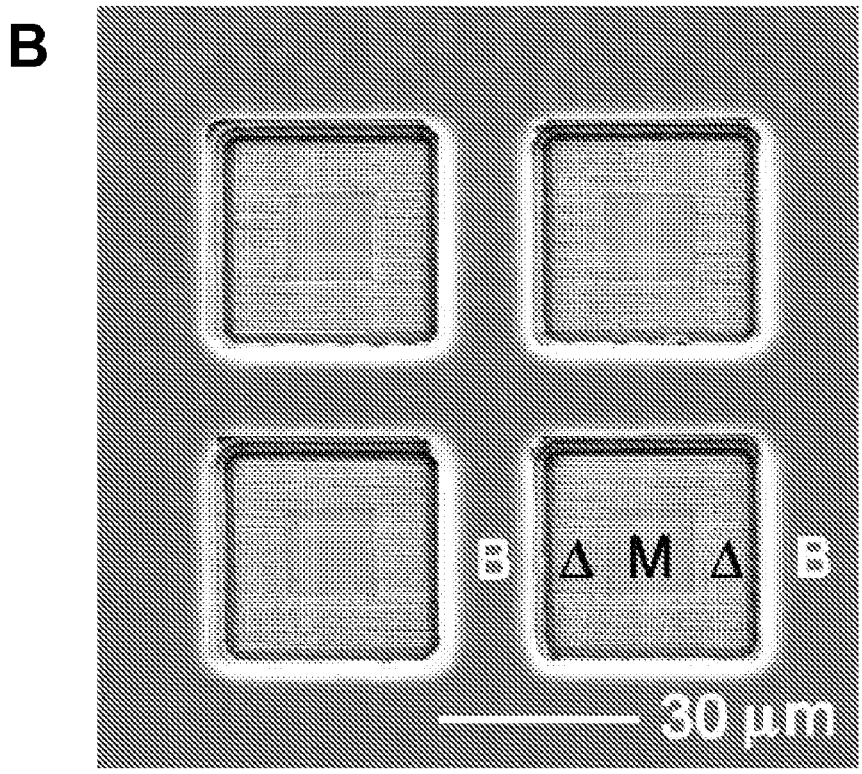
Figure 2:
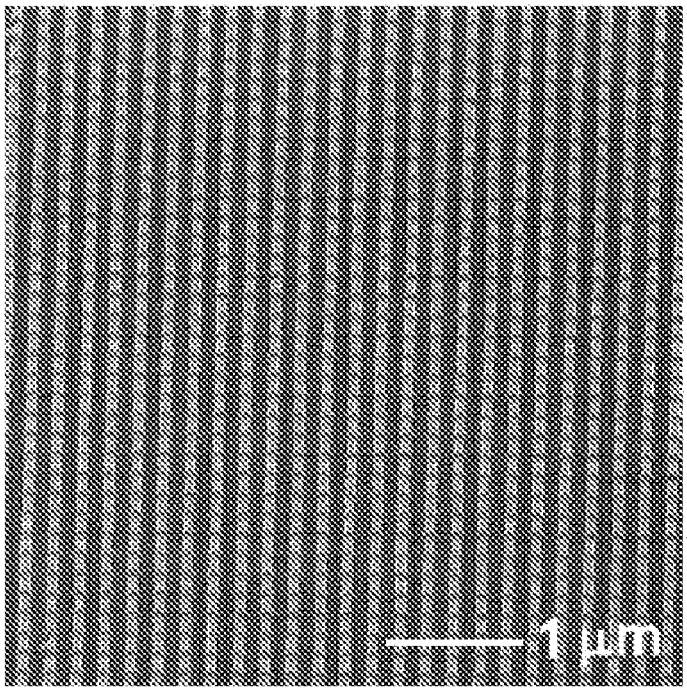
Figure 2:
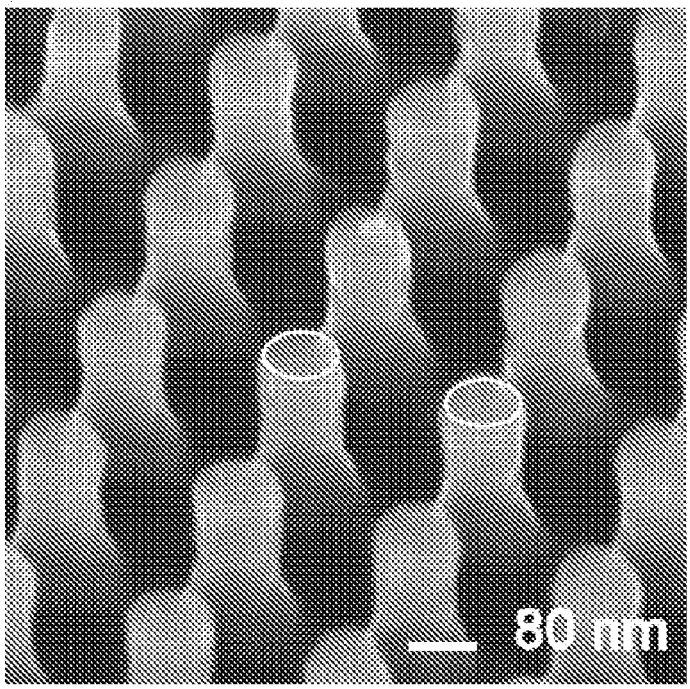
Figure 2:
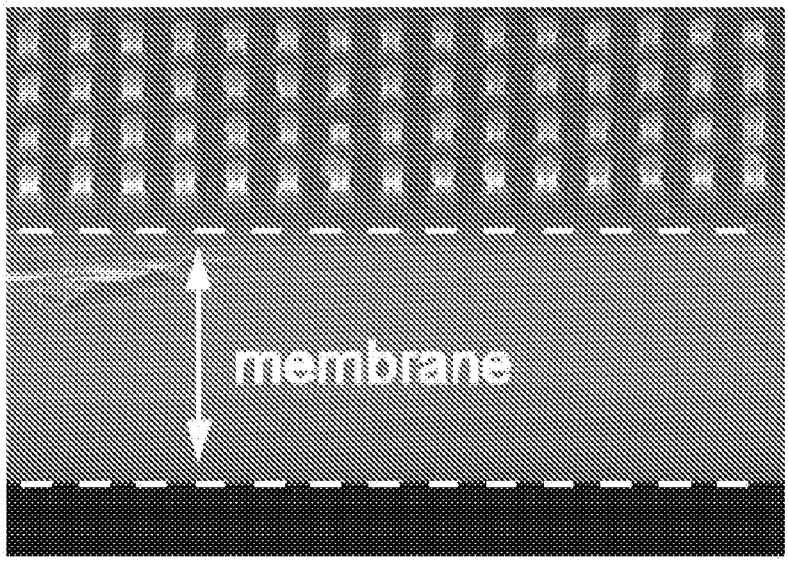
Figure 2:
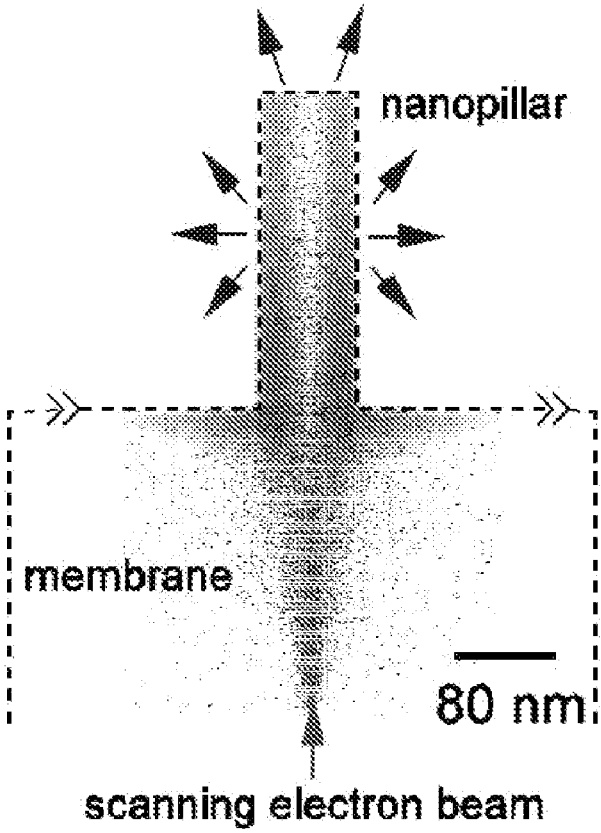

For the purpose of this Example we fabricated several membranes from n-type silicon-on-insulator (SOI) wafers consisting of a 3-micron thin layer of silicon on an insulating layer of silicon dioxide (1.1 μm), as schematically shown in FIG. 2(*a*). The substrate is of n-type silicon with a thickness of 725 μm. The resistivity of the SOI is of the order of 12 Ω·cm. Both the SOI and the silicon substrate have a crystal orientation of (100). The SOI was thinned down to 2.9 μm by thermal oxidation, hence forming a 250 nm layer of silicon dioxide on top. The whole wafer was then capped with a thin layer of silicon nitride (~400 nm) by using low pressure chemical vapor deposition (LPCVD). Being chemically resistive to potassium hydroxide (KOH) solution, the silicon nitride coating allows for opening windows on both sides of the wafer. An anisotropic KOH etch was used to form thin silicon membranes. The final membranes of square shape have a side length of 35 μm. On each device 16 such identical membranes were fabricated into four 2×2 arrays. A scanning electron micrograph of four membranes is shown in FIG. 2(*b*).

On each membrane, an array of round nanopillars was fabricated from the silicon membrane. The pattern of nanopillars was written by electron-beam lithography (EBL), which defined an etch mask so that arrays of nanopillars were formed in a reactive-ion etch (RIE) process. Each pillar has a diameter of 80 nm and a height of 300 nm. The thickness of membranes shown in FIG. 2(*b*) is about 1.6 μm. Finally, the gold mask was removed in a wet chemical etch step, leaving clean silicon nanopillars on the membranes. Close-ups of nanopillar arrays with a pitch of 200 nm are shown in FIG. 2(*c*) and (*d*). In FIG. 2(*e*), the SEM graph of a cleaved membrane reveals the overall architecture of one-dimensional nanopillars placed on the two-dimensional membrane. Also indicated in FIG. 2(*b*) the nanopillars are patterned in a frame marked Δ around the center piece of pure membrane marked M. This allows to discriminate electron transmission through the membrane alone (M), the nanopillar-membrane systems (Δ), and through the bulk material (B) which supports the membrane.

The experimental setup we used is shown schematically in FIG. 2(*a*): the device is mounted in a scanning electron microscope (SEM) which provides a vacuum environment ($p \sim 10^{-6}$ mbar) and most importantly a controllable electron beam. The electron beam is scanned over the backside of the membrane to inject electrons in the energy range of $E_p$=1-30 keV. The membrane is connected to ground in order to avoid accumulation of electrons and thus the generation of a background charge. A large anode is placed above the nanopillars, providing an extraction or retarding voltage ($V_a$) for electrons emitted from the membrane and nanopillars. Most importantly, the anode is designed as a Faraday cup such that the efficiency of collecting electrons approaches 100%. Furthermore, a large anode-membrane distance (~1.5 mm) is used to reduce the number of electrons which are backscattered from the anode and then reenter the membrane-nanopillar system. By controlling the anode voltage while monitoring the anode current $I_a$, secondary electron emission (E<100 eV) can be differentiated from electrons transmitted directly through the device ($E \leqq E_p$) [8] or field emitted electrons (E>150 eV). This provides a simple method to analyze the energy distribution of emitted electrons and allows for identifying the effect of nanopillars on electron emission. This experimental setup is similar to a scanning transmission electron microscope (STEM) [12, 13]. However, the aim here is not to obtain an atomic resolution which requires an ultra-thin membrane like in a STEM. The experimental results shown below will demonstrate that electron emission is enhanced by introducing nanopillars on the exit side of a thin membrane.

Finally, the inset in FIG. 2(*f*) shows a Monte-Carlo simulation with a spatial distribution of primary electrons (colorized dots) entering from below and secondary electron emission (gray scale in red color) in a nanopillar-membrane device. It is precisely the SEE in the pillars that enhances the overall electron generation. In other words the surface increase of the 2D-membrane by the 1D-nanopillars enhances SEE generation to a degree where the membrane amplifies the incoming number of electrons more effectively than a 3D system. Thus adding the dimensions 2D+1D as for the nanopillar-membrane system not necessarily leads to the behavior of the 3D bulk system.

Figure 3:
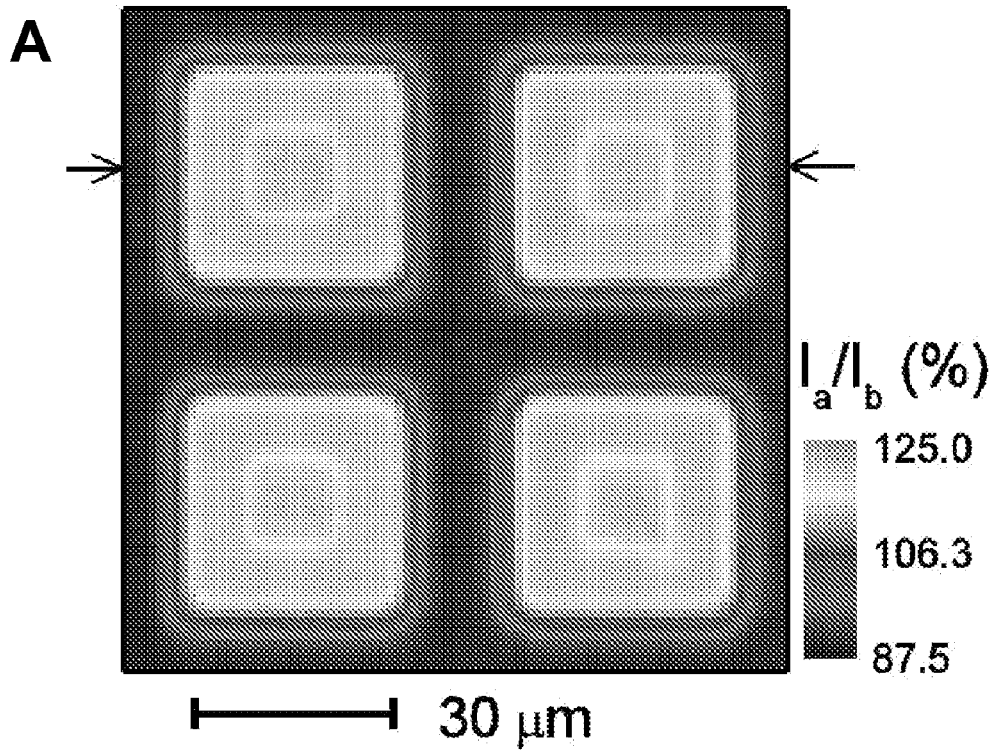
FIG. 3. Mapping of electron emission signal. (a) A color scale plot of anode current as a function of the position of the scanning electron beam. In the experiments, the applied anode voltage ($V_a$) was +200 V. The incident electron energy was 30 keV. The current of the scanning-electron beam ($I_b$) was set at 200 pA. (b) A line scan taken between the two arrows shown in a. The presented anode signal is normalized by the incident beam current.
Figure 3:
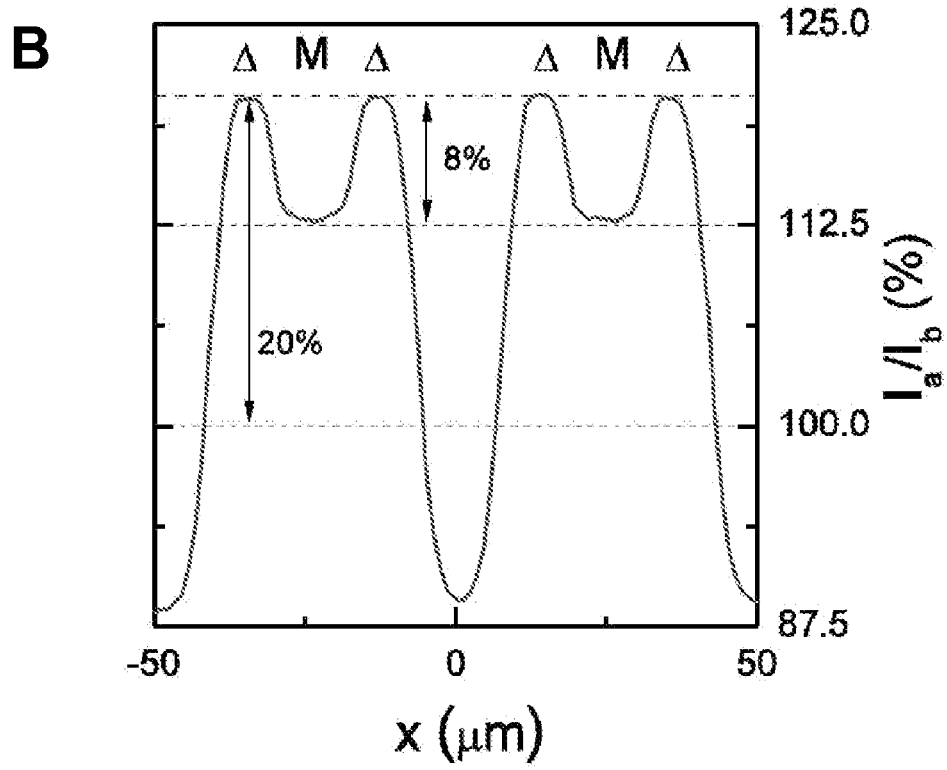

FIG. 3(*a*) shows a color scale map of the anode current as a function of the position of the electron beam scanning over the back side of four membranes. We can directly compare this map with the SEM image shown in FIG. 2(*b*). We find that the anode signal provides a high contrast in membrane thickness and shows a clear enhancement of electron emission where the electron beam hits the area with nanopillars sitting on the other side (Δ compared to M). The plot in FIG. 3(*b*) represents a line scan taken from the corresponding color scale map. As seen one can directly follow transitions between non-membrane area (B), membrane (M) and membrane with nanopillars (Δ). Comparing to the signal from area M, enhanced emission from nanopillars is clearly observed.

Figure 4:
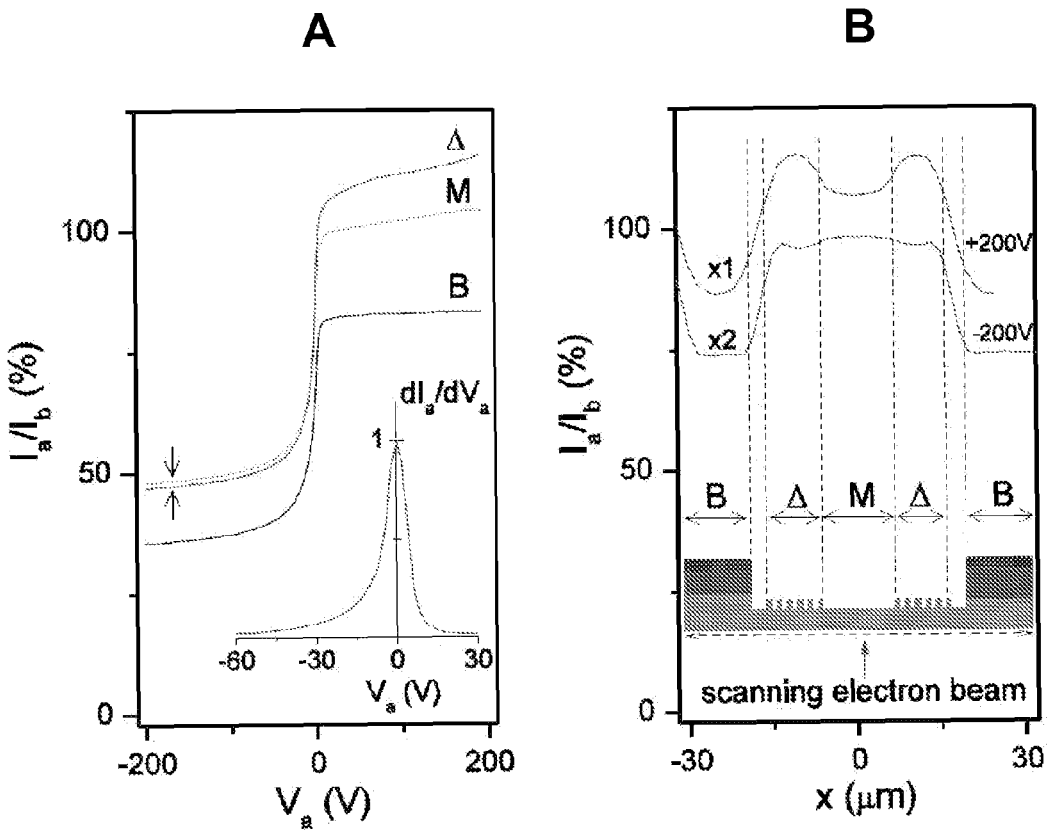
FIG. 4. Effect of nanopillars. (a) The anode current signals as a function of the anode voltage were probed for comparison when the scanning-electron beam was located in areas B, M and Δ. The incident electrons had an energy of 30 keV and the beam current was 200 pA. The inset displays the energy distribution of secondary electrons emitted from area Δ. (b) Two line scans across a single membrane and covering areas B, M and Δ were taken at $V_a$=−200 V and $V_a$=+200 V for comparison. For clarity, the amplitude of the line scan taken at $V_a$=−200 V is multiplied by a factor of 2. At positive bias, enhancement of SEE is found in the area with nanopillars. At negative bias, however, nanopillars suppress the transmission of incident primary electrons.

The origin of enhanced SEE from the nanopillars is further explored by altering the anode voltage $V_a$. Since the anode with a negative potential will keep electrons with energy below $e|V_a|$ from reaching the anode, it thus provides a method to analyze the energy of emitted electrons by sweeping the anode voltage. The $I_aV_a$-characteristics in FIG. 4 were measured for the three distinct areas (B, M and Δ) for comparison. The anode voltage was swept from −200 V to +200 V. As shown in FIG. 4(*a*), constant levels of anode current are observed when $V_a$<−150 V. These levels reflect the contributions from those electrons transmitted through the nanopillar-membrane system where the electrons' energy is only slightly attenuated ($E \leqq E_p$). Upon further increasing the anode voltage up to +30 V, a continuous rise in the anode current due SEE is found. Above $V_a$=+30 V, most transmitted primary and secondary electrons are collected by the anode and the anode current reaches a saturation value. In FIG. 4(*a*), the black curve shows the electron emission through the non-membrane area (B), which is suppressed in reverse bias to 36% and increased in the forward direction to about 83%. The increase of 47% is the contribution from secondary electrons. Turning now to the signals from membrane (M) and the nanopillar-membrane system (Δ), we can see the direct transmission of the primary electrons is increased by about 12%, where this increase relates to the thinness of the membrane comparing to the unprocessed multi layers (B). However, the contribution from SEE is increased to 57% for area M and 67% for area Δ. Because of the increase in SEE, the total emission current becomes greater than the incident current, i.e., a gain is achieved.

We find that in contrast to the intuitive assumption—that is the thinner membrane the higher the transmission should be—a membrane with nanopillars shows an even more enhanced signal. As shown in the inset of FIG. 4(*a*), the derivative of the Δ-trace with respect to the anode voltage represents the energy distribution of the secondary electrons. We further examined the effects of nanopillars on electron emission by scanning an electron beam (30 keV) across the nanopillar frame at $V_a$=±200 V. Electron emission from areas B, M and Δ are compared directly in FIG. 4(*b*). A remarkable influence of the nanopillars (Δ-peaks) is found. Under a forward anode bias $V_a$=+200 V, same as that in FIG. 3(*b*), an enhancement of SEE by the nanopillars is clearly observed. Furthermore, under reverse anode bias $V_a$=−200 V, transmission of primary electrons is slightly suppressed by the nanopillars. This is a clear indication that the nanopillars absorb high-energy primary electrons and generate more low-energy secondary electrons than the plane 2D-membrane.

This effect also suggests that in order to obtain an optimal efficiency of SEE the ratio of membrane thickness to the pillar height and the aspect ratio of nanopillars has to be carefully tuned. Comparing to curve B in FIG. 4(*a*), it has to be noted that curve M has a stronger dependence on the positive anode potential. This is directly related to the fact that the electric field in the recessed membrane area is retarded. Furthermore, the even stronger dependence on anode potential found in area Δ stems from the suppression of the electric field on the nanopillar sidewall by neighboring pillars. Nevertheless, it is of great interest to explore electron emission at even higher electrical fields at the surface of nanopillars so that electron field emission can kick in and help removing the generated electrons from the pillars.

Figure 5:
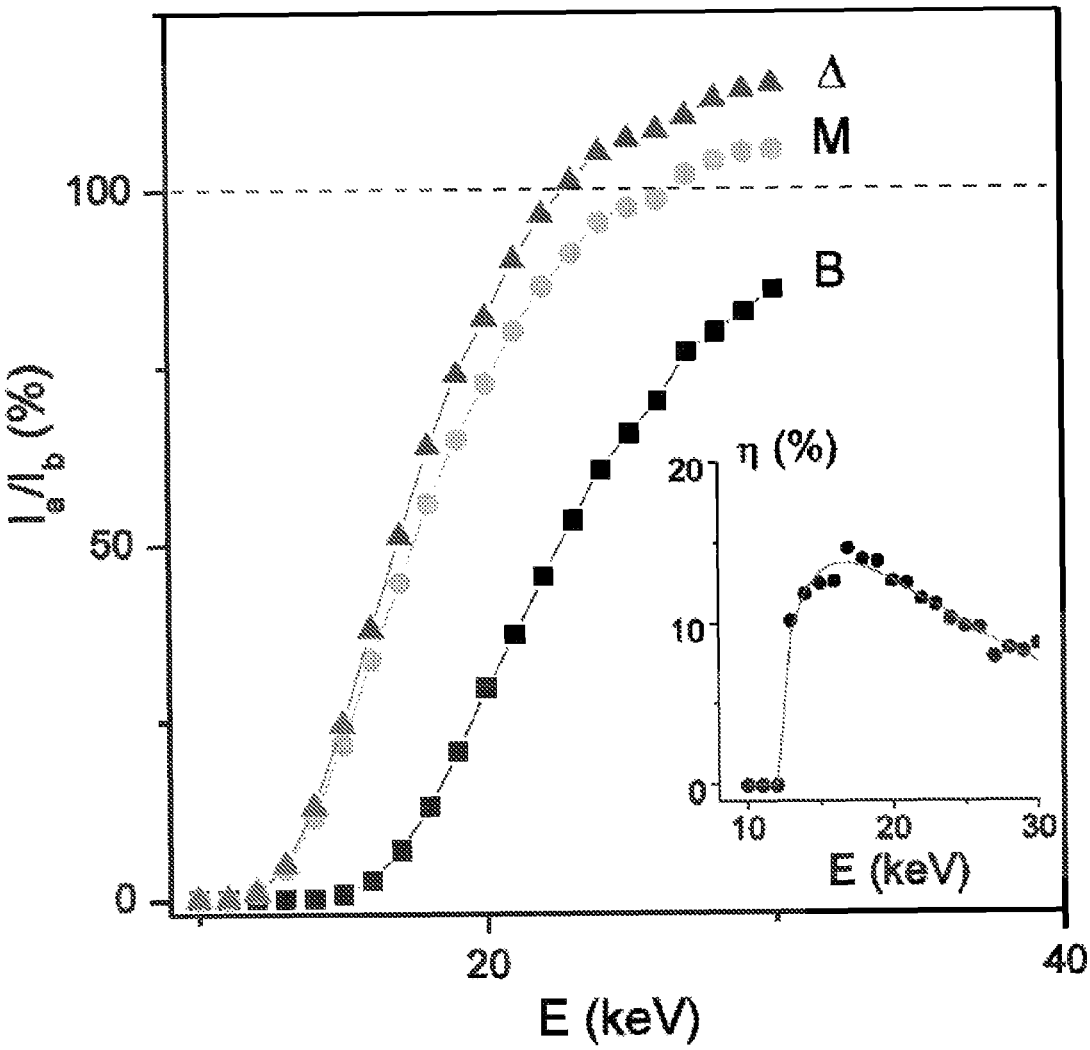
FIG. 5. Threshold energy and gain. The dependence of anode current on the incident electron energy is compared for areas B, M and Δ. The incident beam current was 200 pA and the anode voltage was +200 V. A threshold in energy is found around 12.5 keV. A gain is observed above $E_p$=23 keV for area Δ and $E_p$=26 keV for area M. No gain is found for area B. The inset presents the energy dependence of the enhancement factor for SEE from the nanopillar-membrane system.

The above results were obtained for an incident electron energy of 30 keV. The dependence of electron emission on the incident energy is shown in FIG. 5. Again emission signals from areas B, M and Δ are compared for $V_a$=+200 V. The threshold energy for electrons to 'penetrate' the thin membrane is about 12.5 keV which is 3 keV lower than that of bulk area. There is no observable shift in the threshold energy comparing areas M and Δ. However, nanopillars significantly increase the emission signal. Above 30 keV, which is the maximal electron energy available in this SEM, a saturation of the anode current levels is observed. In order to extract the effect of the nanopillars we define an enhancement factor $\eta=(I_\Delta-I_M)/I_M$, where $I_\Delta$ and $I_M$ represent anode currents normalized by the beam current $I_b$, when the electron beam is located in area Δ and M, respectively. The energy dependence of η is shown in the inset of FIG. 5: the optimal energy range for SEE enhancement is between 13 to 24 keV. A total enhancement of 14% is obtained at $E_p$=16 keV. Above this optimal energy level, the enhancement from nanopillars decreases, since both the elastic and inelastic mean-free-paths ($\lambda=A/N_aZ\rho\sigma$) of electrons in silicon increase with energy, where $N_a$ is Avogadro's constant, σ is the elastic/inelastic cross section for electron scattering in silicon, ρ is the density of the silicon membrane material, and A and Z are the atomic weight and atomic number for silicon, respectively. For 16 keV electrons, the elastic and inelastic mean-free-paths are about 20 nm and 60 nm at room temperature, respectively. Both are comparable to the diameter and height of the nanopillars indicating each incident electron entered the nanopillars will experience a few inelastic scatterings.

The most plausible cause for this enhancement is the induced change of surface morphology by the nanopillars, which increase the surface area and the effective incident angle for electrons approaching the side wall from within the nanopillars (see MC-simulation in FIG. 2 (*f*)). In the frame of this interpretation, the normalized anode current can be expressed as $I_a|I_b=\beta\gamma_p+(1-\beta)\gamma_m$, where β is the coverage of the membrane surface by nanopillars, $\gamma_m$ and $\gamma_p$ are the yield of SEE for membrane and nanopillar-membrane, respectively. In area Δ, it is clear that $\beta=\pi d^2/4L^2\approx0.13$, where d is the diameter of the nanopillars, and L is the pitch distance. The enhancement factor becomes $\eta=\beta(\gamma_p/\gamma_m-1)$. Based on the experimental enhancement factor (14%) obtained at $E_p$=16 keV, we estimated the ratio $\gamma_p/\gamma_m$ is about 2.1, i.e., the SEE yield from the nanopillar-membrane system is about two times that from a planar membrane. By reducing the distance between nanopillars from 200 nm to 150 nm and keeping the pillar's dimension unchanged, β can be doubled and hence η will increase from 14% to 28%. A higher yield of SEE can simply be realized by choosing a membrane material with higher yield of SEE, e.g., diamond [14]. Integration of nanopillars on a membrane has two obvious advantages: (i) it naturally provides an extra boost to SEE by the geometrical change of the emission surface, as we have seen and (ii) it provides an array of pointing emitters, which has the great potential to include other emission mechanisms such as electron field emission and phonon/photon-assisted tunneling.

Figure 6:
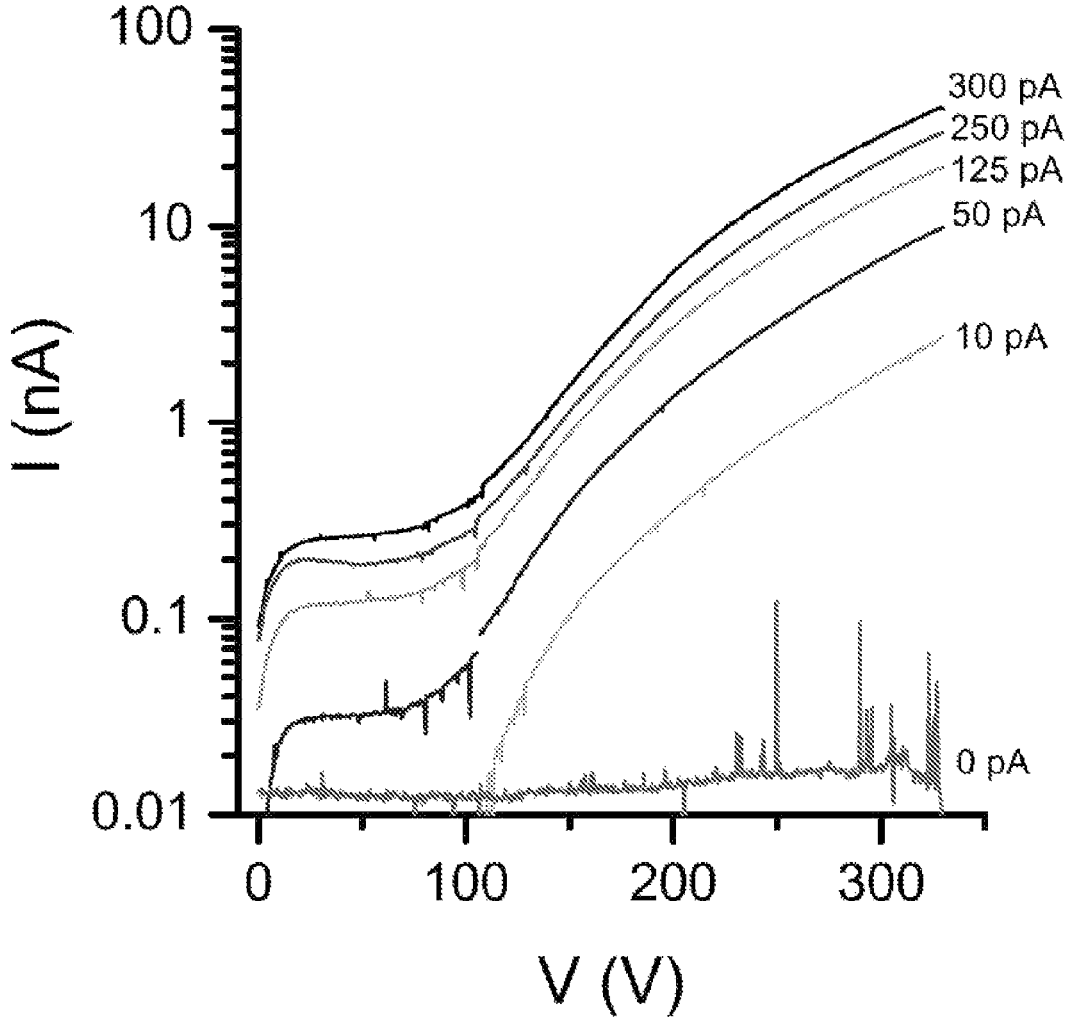
FIG. 6 provides a plot of current (nA) vs. anode voltage for the nanopillar electron emissive device shown in FIG. 2. The current is plotted on a logarithmic scale in this figure.

FIG. 6 provides a plot of current (nA) vs. anode voltage for the electron emissive device shown in FIG. 2. Current is plotted on a logarithmic scale in this figure. Plots are provided for incident primary electron beams having currents of 10 pA, 50 pA, 125 pA, 250 pA and 300 pA. As shown in FIG. 2, a very large increase in current is observed when the voltage applied to the nanopillar array by the anode is increased past a value of about 100 V. The observed increase in current is due to field emission from the nanopillars in the array initiated by the applied potential difference. These experimental results demonstrate that the present electron emission devices and structures are capable of generating field emission, in addition to secondary electron emission. Specifically, FIG. 6 shows that the device configuration provided in FIG. 2 and described in detail above is capable of operating in a secondary emission mode for applied voltages less than about 100 V and operating in a field emission mode for applied voltages greater than about 100 V. In some applications, it is useful to operate the present electron emission systems in a voltage domain near the transition between secondary emission and field emission operating modes.

In summary we demonstrated that a nano-structured membrane strongly enhances secondary electron emission. Since the geometry of the nanopillars and the arrays can be freely chosen the interaction of the incident particle and thus the energy bandwidth can be optimized. Furthermore, nanopillar-membranes can be stacked for achieving even higher gain. In addition, the present device configuration can be adapted to integrate different heterostructure materials to integrate p-n junctions, quantum wells, etc., which further enhances the functionality of this nanopillar-membrane system. This enables achieving an active device with gain and to tailor the energy resolution of this 'window'-type detector. The functions of the membrane and nanopillars could also be separated so that the membrane will act as a filter for incident particles while the nanopillars are the active detector elements. This architecture has applications in radiation and particle detectors and non-contact bio/chemical sensors.

Example 2

Incorporation of a Gaseous Medium within the Nanopillar Arrays

In some embodiments of the present invention, additional gain in signal is realized by operating the nanopillar array with selected gases, such as a mixture of gases such as Ar, Ne, He, $N_2$, $O_2$, $CO_2$, and $CH_4$ gases, encapsulated between the nanopillar side of the membrane and the collection anode/Faraday cup. In this device configuration, the electrons emitted by the nanopillars are accelerated by the potential difference between the collector and the nanopillar array provided in electrical contact with the internal surface of the semiconductor membrane. If the voltage is adjusted such that the electric field in this region reaches a threshold magnitude, for example 100 kV/cm for a mixture of Ar and $CH_4$ gases, a single electron emerging from a pillar will acquire enough energy to ionize the gas and start an electron cascade, resulting in the generation of $10^4$ to $10^5$ electrons. Embodiments of this aspect of the present invention are capable of provide a large overall detector gain, e.g., on the order of $10^5$.

Example 3

Secondary Electron Generation Using an Embedded N P Junction Structure

The present invention includes electron emission devices having an array of nanopillars comprising embedded N P junction structures. To evaluate the capabilities of nanopillars having embedded N P junction structures, a semiconductor membrane made of silicon and silicon oxide embedded N P junctions was fabricated and exposed to a source of electrons. The results of this Example demonstrate that embedded N P junctions provide useful structures for generating secondary electron emission and field emission.

Conventional electron multipliers typically have many cascade stages with each stage has a gain of only 1-10 depending on the secondary electron emission (SEE) yield. The semiconductor membrane electron multipliers described in this example are capable of providing a gain larger than 1000 from a single stage comprising a semiconductor membrane as the cathode, an anode and an insulating layer provided between the cathode and anode. In the present systems, the gain is realized by field emission enhanced electron extraction. The semiconductor membrane upon bombardment of an incident electron beam holds a large number of electrons moving towards the exit side. Only a small fraction of the electrons can escape the membrane, however, and thereby become the so-called secondary emitted electrons. Most of the electrons, however, can not be released because of the energy is lower than the work function. This situation is changed once there is a high electric field applied on the exit side. From the experiments described herein, we clearly show that a gain of 10 k possible using the present semiconductor membrane structures. These measurements demonstrate that the present semiconductor membrane structures allow extraction of the 'produced' electrons in the semiconductor membranes via a field emission mechanism involving an applied electric field.

Figure 7:
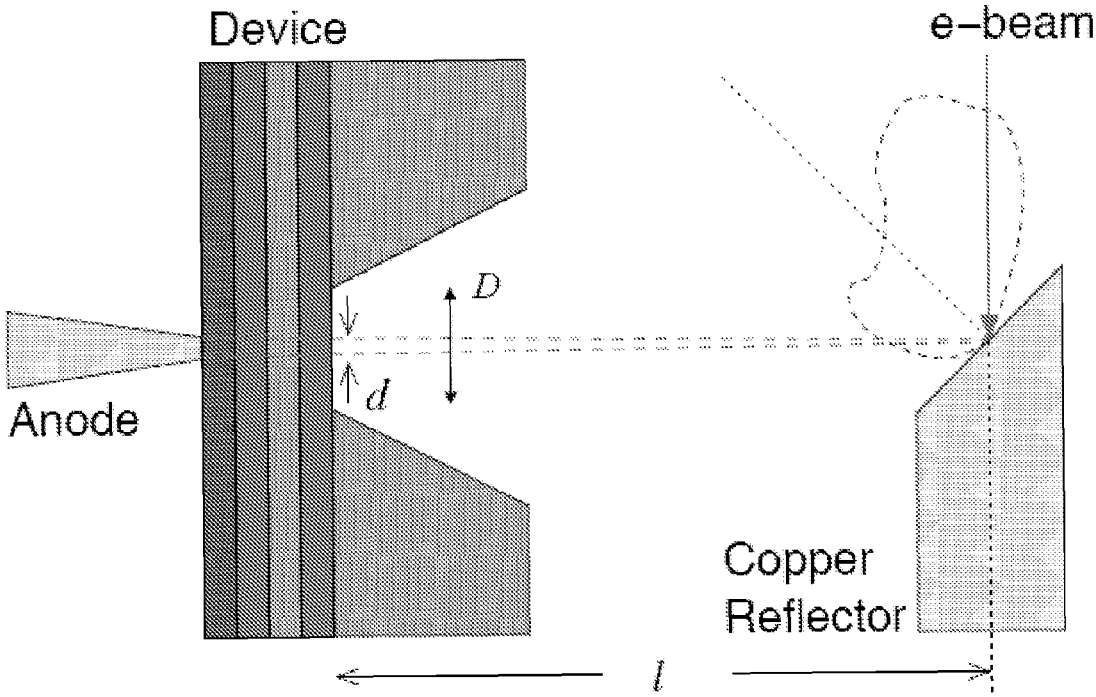
FIG. 7 provides a schematic of an experimental setup for evaluating the electron emission properties of a semiconductor membrane structure comprising an embedded N P junction.

FIG. 7 provides a schematic of an experimental setup for evaluating the electron emission properties of a semiconductor membrane structure comprising an embedded N P junction structure. Starting from the sensing side of the membrane where electrons impact the membrane, the layer sequence is: (a) a thin layer of silicon membrane, the thickness should be thinner for lower energy electrons; an optimal thickness for 18 keV is about 1.5 um. (b) a thin layer of silicon oxide (~1 um), the thickness can be tuned to match to the threshold field for field emission and the break down field of silicon oxide; (c) a layer of silicon nitride (~300 nm) is optional; and (d) a layer of gold doped poly silicon as anode, the thickness of this layer is not critical. As will be understood by those having ordinary skill in the art, the membrane can be made of other materials such as diamond which will yield a higher gain due to a lower work function or a negative electron affinity.

As illustrated in this figure, an electron beam is directed at a copper reflector in a manner resulting in generation of secondary electrons. The secondary electrons from the copper block are directed at the semiconductor membrane comprising a silicon-silicon oxide N P junction. Electrons emitted from the semiconductor membrane are detected using a micron-sized anode in close proximity to the semiconductor membrane structure.

Figure 8:
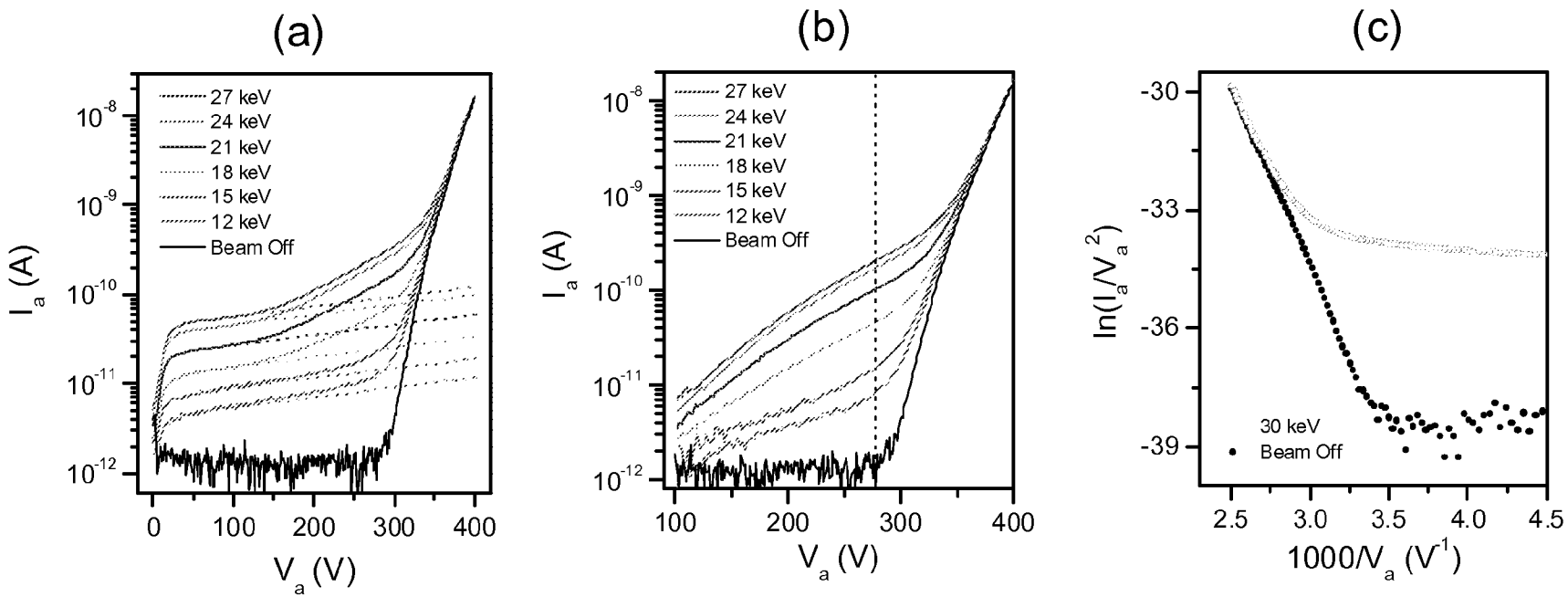
FIG. 8(*a*) shows the onset of SEE (secondary electron emission) and FE (field emission) plotted as anode current $I_a$ vs. anode voltage $V_a$ with electron beam energies ranging from 0-27 keV.
Figure 9:
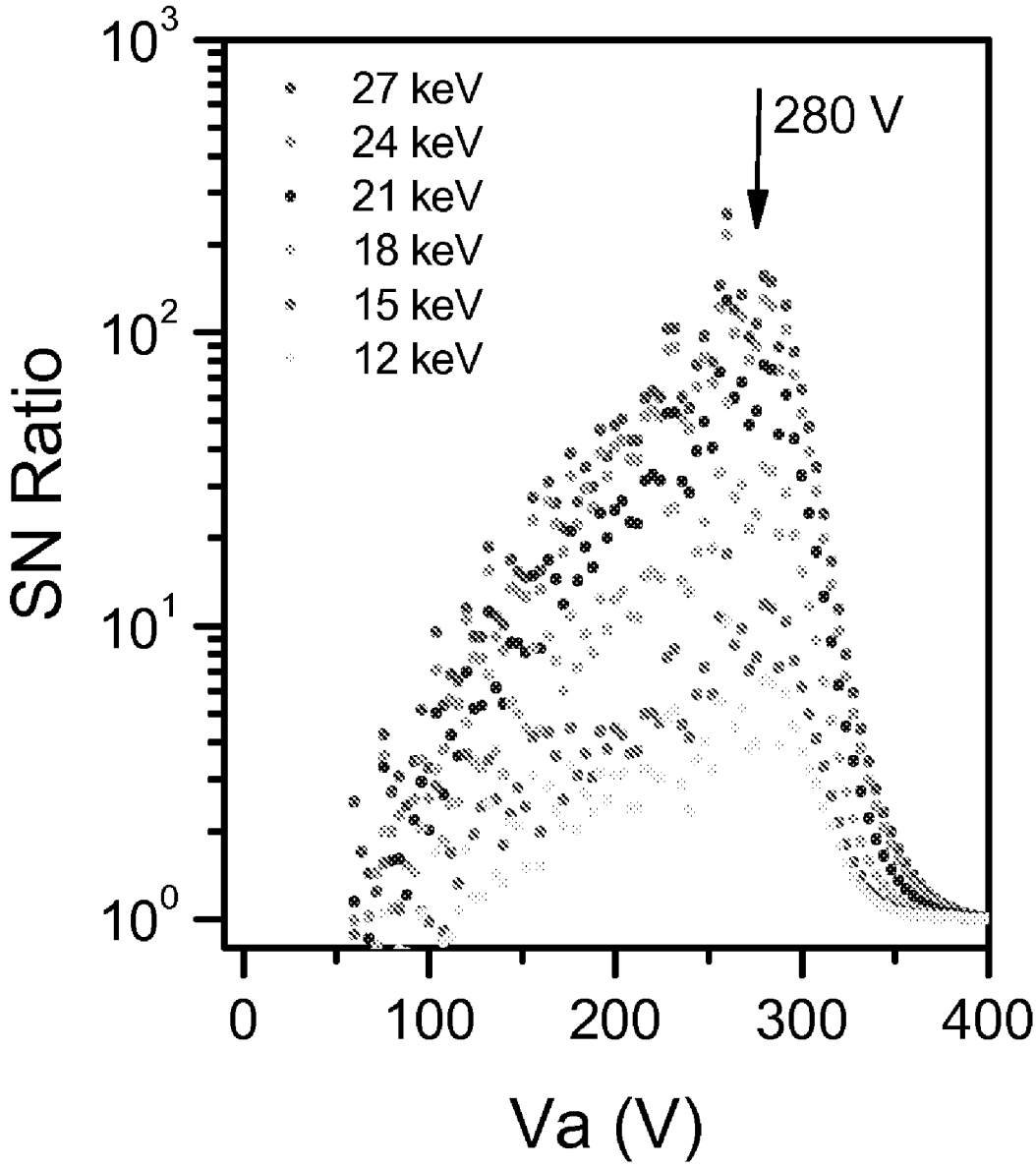
FIG. 9 provides the signal-to-noise ratio as a function of the anode voltage.

FIGS. 8*a*-8*b* provide measurements of the current detected upon exposure of the semiconductor membrane to secondary electrons from the copper reflector. FIG. 8(*a*) shows the onset of SEE (secondary electron emission) and FE (field emission) plotted as anode current $I_a$ vs. anode voltage $V_a$ with electron beam energies ranging from 0-27 keV. FIG. 8(*b*) shows the pure field emission current by subtracting the secondary electron emission current. FIG. 8(*c*) shows the Fowler-Nordheim presentation of field emission. From the secondary electron emission yield, the effective number of electrons injected is about 0.1 pA, i.e., below the noise floor of the measurement system. The gain from field emission is about 2500 for E=27 keV, FIG. 9 provides the signal-to-noise ratio as a function of the anode voltage. The noise results from the background current, i.e., the field emission current without any e-beam excitation, as shown in previous figures. It is clear that the SN ratio reaches its maximum at the sub-threshold voltage. A difference of two orders of magnitude can be seen.

STATEMENTS REGARDING INCORPORATION BY REFERENCE AND VARIATIONS

The Appendix included herewith is a part of the present specification and is incorporated by reference in its entirety.

All references throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments, exemplary embodiments and optional features, modification and variation of the concepts herein disclosed may be resorted to by those skilled in the art, and that such modifications and variations are considered to be within the scope of this invention as defined by the appended claims. The specific embodiments provided herein are examples of useful embodiments of the present invention and it will be apparent to one skilled in the art that the present invention may be carried out using a large number of variations of the devices, device components, methods steps set forth in the present description. As will be obvious to one of skill in the art, methods and devices useful for the present methods can include a large number of optional composition and processing elements and steps.

When a group of substituents is disclosed herein, it is understood that all individual members of that group and all subgroups, including any isomers, enantiomers, and diastereomers of the group members, are disclosed separately. When a Markush group or other grouping is used herein, all individual members of the group and all combinations and subcombinations possible of the group are intended to be individually included in the disclosure. When a compound is described herein such that a particular isomer, enantiomer or diastereomer of the compound is not specified, for example, in a formula or in a chemical name, that description is intended to include each isomers and enantiomer of the compound described individual or in any combination. Additionally, unless otherwise specified, all isotopic variants of compounds disclosed herein are intended to be encompassed by the disclosure. For example, it will be understood that any one or more hydrogens in a molecule disclosed can be replaced with deuterium or tritium. Isotopic variants of a molecule are generally useful as standards in assays for the molecule and in chemical and biological research related to the molecule or its use. Methods for making such isotopic variants are known in the art. Specific names of compounds are intended to be exemplary, as it is known that one of ordinary skill in the art can name the same compounds differently.

Whenever a range is given in the specification, for example, a temperature range, a time range, or a composition or concentration range, all intermediate ranges and subranges, as well as all individual values included in the ranges given are intended to be included in the disclosure. It will be understood that any subranges or individual values in a range or subrange that are included in the description herein can be excluded from the claims herein.

All patents and publications mentioned in the specification are indicative of the levels of skill of those skilled in the art to which the invention pertains. References cited herein are incorporated by reference herein in their entirety to indicate the state of the art as of their publication or filing date and it is intended that this information can be employed herein, if needed, to exclude specific embodiments that are in the prior art. For example, when composition of matter are claimed, it should be understood that compounds known and available in the art prior to Applicant's invention, including compounds for which an enabling disclosure is provided in the references cited herein, are not intended to be included in the composition of matter claims herein.

As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" may be replaced with either of the other two terms. The invention illustratively described herein suitably may be practiced in the absence of any element or elements, limitation or limitations which is not specifically disclosed herein.

One of ordinary skill in the art will appreciate that starting materials, biological materials, reagents, synthetic methods, purification methods, analytical methods, assay methods, and biological methods other than those specifically exemplified can be employed in the practice of the invention without resort to undue experimentation. All art-known functional equivalents, of any such materials and methods are intended to be included in this invention. The terms and expressions which have been employed are used as terms of description and not of limitation, and there is no intention that in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

REFERENCES

[1] Deshmukh, M., Ralph, D. C., Thomas, M. & Silcox, J. *Nanofabrication using a stencil mask*, Appl. Phys. Lett. 75, 1631-1633 (1999).

[2] Yamashita, H., Amemiya, I., Nomura, E., Nakajima, K. & Nozue, H. *High-performance membrane mask for electron projection lithography*, J. Vac. Sci. Technol. B 18 (6), 3237-3241 (2000).

[3] Seamster, A. G., Green, R. E. L. & Korteling, R. G. *Silicon detector DeltaE-E particle identification: A theoretically based analysis algorithm and remarks on the fundamental limits to the resolution of particle type by DeltaE-E memasurements*, Nucl. Instr. and Meth. 145, 583-591 (1977).

[4] Stab, L. *Thin epitaxial silicon detectors*, Nucl. Instr. and Meth. A288, 24-30 (1990).

[5] Wilcock, W. L., Emberson, D. L. & Weekley, B. *An image intensifier with transmitted secondary electron multiplication*, Nature 185, 370-371 (1960).

[6] Kamiya, T., Cholewa, M., Saint, A., Prawer, S., Legge, G. J. F., Butler, J. E. & Jr. Vestyck, D. J. *Secondary electron emission from boron-doped diamond under ion impact: Applications in single-ion detection*, Appl. Phys. Lett. 71, 1875-1877 (1997).

[7] Porter, F. S., McCammon, D., Galeazzi, M., and Stahle, C. K. (Editors), *Low temperature detectors: Ninth International Workshop on Low Temperature Detectors*, AIP Conference Proceedings 605 (2001).

[8] Bruining, H., *Physics and applications of secondary electron emission*, McGraw-Hill Book Co., Inc: New York (1954).

[9] Johnson, J. B. & McKay, K. G. *Secondary electron emission from germanium*, Physical Review 93, 668-672 (1954).

[10] Kanter, H. *Energy Dissipation and Secondary Electron Emission in Solids*, Phys. Rev. 121, 677-681 (1961).

[11] Egerton, R. F. *Electron energy-loss spectroscopy*, Plenum Press, New York (1986).

[12] Crewe, A. V., Wall J. & Langmore J. L. *Visibility of single atoms*, Science 168, 1338-1340 (1970).

[13] Browning, N. D., Chisholm M. F. & Pennycook S. J. *Atomic-resolution chemical analysis using a scanning transmission electron microscope*, Nature 366, 143-146 (1993).

[14] Geis, M. W., Efremov, N. N., Krohn, K. E., Twichell, J. C., Lyszczarz, T. M., Kalish, R., Greer, J. A. & Tabat, M. D. *A new surface electron-emission mechanism in diamond cathodes*, Nature 393, 431-435 (1998).

We claim:

1. An electron emission device comprising:

a semiconductor membrane having an external surface positioned to receive incident electrons from an electron source and an internal surface positioned opposite to said external surface; wherein said semiconductor membrane is at least partially transmissive to said incident electrons or is capable of generating secondary electrons or other charged particles from said incident electrons; and an array of semiconductor nanopillars provided in electrical contact with said internal surface, wherein electrons or other charged particles transmitted or generated by said semiconductor membrane cause at least a portion of said nanopillars on said internal surface to emit electrons.

2. The device of claim 1 further comprising an anode positioned close enough to said internal surface of said semiconductor membrane so as to establish a selected extraction voltage at said internal surface of said membrane.

3. The device of claim 2 wherein said extraction voltage at said internal surface of said membrane is selected from the range of 50 V to 1000 V.

4. The device of claim 1 wherein said membrane is connected to ground.

5. The device of claim 1 wherein said membrane has an average thickness selected from the range of 10 nanometers to 10 microns.

6. The device of claim 1 wherein said semiconductor nanopillars extend lengths along axes that intersect the internal surface of said membrane, said lengths selected from the range of 100 nanometers to 10 microns.

7. The device of claim 1 wherein said semiconductor nanopillars have average cross sectional lengths, widths or diameter selected from the range of 20 nanometers to 500 nanometers.

8. The system of claim 1 wherein said semiconductor nanopillars have aspect ratios selected from the range of 1 to $10^4$.

9. The system of claim 1 wherein said semiconductor nanopillars extend lengths along axes that intersect the internal surface of said membrane that are between 1 to 20 times the cross sectional length, width or diameter of said membrane.

10. The device of claim 1 wherein the average shortest distance between adjacent nanopillars in said array is selected from the range of 30 nanometers to 30 microns.

11. The device of claim 1 wherein said array has an average density of semiconductor nanopillars selected from the range of $1\times10^{-3}$ micron$^{-2}$ to about 2500 micron$^{-2}$.

12. The device of claim 1 wherein said membrane, said nanopillars or both comprise single crystalline semiconductor materials.

13. The device of claim 1 wherein said membrane, said nanopillars or both are n-type doped semiconductors or p-type doped semiconductors.

14. The device of claim 1 wherein:

said membrane is a n-type doped semiconductor and said nanopillars are p-type doped semiconductors; or said membrane is a p-type doped semiconductor and said nanopillars are n-type doped semiconductors.

15. The device of claim 1 wherein said membrane and said nanopillars form a plurality of p-n junctions.

16. The device of claim 1 wherein at least a portion of said nanopillars comprise one or more device components selected from the group consisting of:

a p-n junction;

a field emissive device component;

a semiconductor heterostructure;

a resonant tunneling diode;

a quantum well;

a light emitting diode;

a laser;

a vertical-cavity surface-emitting laser; and a semiconductor base in electrical contact with a metallic field emitting tip.

17. The device of claim 1 wherein said incident electrons have energies ranging from 1 keV to 200 keV.

18. An electron emission system comprising a plurality of devices of claim 1 provided in a stacked configuration.

19. An amplifier for increasing the intensity of incident electrons from an electron source; said amplifier comprising:

a semiconductor membrane having an external surface positioned to receive said incident electrons from said electron source and an internal surface positioned opposite to said external surface; wherein said semiconductor membrane is at least partially transmissive to said incident electrons or is capable of generating secondary electrons or other charged particles from said incident electrons; and an array of semiconductor nanopillars provided in electrical contact with said internal surface, wherein electrons or other charged particles transmitted or generated by said semiconductor membrane cause at least a portion of said nanopillars on said internal surface to emit electrons, thereby amplifying the intensity of electrons from said electron source.

20. An electronic device comprising:

a plurality of electron emission devices; wherein each of said electron emission devices comprises:

a semiconductor membrane having an external surface positioned to receive incident electrons and an internal surface positioned opposite to said external surface; wherein said semiconductor membrane is at least partially transmissive to said incident electrons or is capable of generating secondary electrons or other charged particles from said incident electrons; and an array of semiconductor nanopillars provided in electrical contact with said internal surface, wherein electrons or other charged particles transmitted or generated by said semiconductor membrane cause at least a portion of said nanopillars on said internal surface to emit electrons;

wherein said electron emission devices are provided in a series configuration, such that a first electron emission device is positioned to receive incident electrons from an electron source, thereby generating emitted electrons from said first electron emission device, and wherein a second electron emission device is positioned to receive at least a portion of said electrons emitted said first electron emission device, thereby generating emitted electrons from said second electron emission device.

21. The device of claim 20 wherein said the array of said first electron emission device has an average density of semiconductor nanopillars larger than that of said array of said second electron emission device.

22. The device of claim 20 further comprising additional electron emission devices provided in said series configuration.

23. The device of claim 22 comprising 1 to 20 of said additional electron emission devices.

24. A detection system for detecting incident electrons; said detector comprising:

a semiconductor membrane having an external surface positioned to receive said incident electrons and an internal surface positioned opposite to said external surface; wherein said semiconductor membrane is at least partially transmissive to said incident electrons or is capable of generating secondary electrons or other charged particles from said incident electrons; and an array of semiconductor nanopillars provided in electrical contact with said internal surface, wherein electrons or other charged particles transmitted or generated by said semiconductor membrane cause at least a portion of said nanopillars on said internal surface to emit electrons; and an electron detector positioned to detect at least a portion of said electrons emitted by said nanopillars on said internal surface.

25. The detection system of claim 24 further comprising an anode positioned between said internal surface of said semiconductor membrane and said detector.

26. The detection system of claim 24 further comprising one or more gases provided between said array of semiconductor nanopillars and said detector.

27. The detector system of claim 26 wherein said one or more gases are provided in chamber positioned between said array of semiconductor nanopillars and said detector.

28. The detector of claim 26 wherein said one or more gases are selected from the group consisting of Ar, Ne, He, $CH_4$.

29. A system for generating electrons comprising:

an electron source for generating incident electrons;

a semiconductor membrane having an external surface positioned to receive said incident electrons from said electron source and an internal surface positioned opposite to said external surface; wherein said semiconductor membrane is at least partially transmissive to said incident electrons or is capable of generating secondary electrons or other charged particles from said incident electrons; and an array of semiconductor nanopillars provided in electrical contact with said internal surface, wherein electrons or charged particles transmitted or generated by said semiconductor membrane cause at least a portion of said nanopillars on said internal surface to emit electrons, thereby generating electrons.

30. A method for increasing the intensity of incident electrons from an electron source; said method comprising the steps:

providing said electron source for generating incident electrons;

providing an electron amplifier comprising:

a semiconductor membrane having an external surface positioned to receive said incident electrons from said electron source and an internal surface positioned opposite to said external surface; wherein said semiconductor membrane is at least partially transmissive to said incident electrons or is capable of generating secondary electrons or other charged particles from said incident electrons; and an array of semiconductor nanopillars provided in electrical contact with said internal surface; and exposing said electron amplifier to said incident electrons from said electron source, wherein electrons or other charged particles transmitted or generated by said semiconductor membrane cause at least a portion of said nanopillars on said internal surface to emit electrons, thereby increasing the intensity of incident electrons from said electron source.

31. A method for detecting incident electrons; said method comprising the steps:

providing a detector comprising:

a semiconductor membrane having an external surface positioned to receive said incident electrons and an internal surface positioned opposite to said external surface; wherein said semiconductor membrane is at least partially transmissive to said incident electrons or is capable of generating secondary electrons or other charged particles from said incident electrons; and an array of semiconductor nanopillars provided in electrical contact with said internal surface, wherein electrons or other charged particles transmitted or generated by said semiconductor membrane cause at least a portion of said nanopillars on said internal surface to emit electrons; and an electron detector positioned to detect electrons emitted by said nanopillars; and exposing said external surface of said semiconductor membrane of said detector to said incident electrons; and detecting at least a portion of said electrons emitted by said nanopillars on said internal surface of said membrane, thereby detecting said incident electrons.

32. A method for generating electrons; said method comprising the steps:

providing an electron source for generating incident electrons;

providing a semiconductor membrane having an external surface positioned to receive said incident electrons from said electron source and an internal surface positioned opposite to said external surface; wherein said semiconductor membrane is at least partially transmissive to said incident electrons or is capable of generating secondary electrons or other charged particles from said incident electrons; and providing an array of semiconductor nanopillars in electrical contact with said internal surface, wherein electrons or other charged particles transmitted or generated by said semiconductor membrane cause at least a portion of said nanopillars on said internal surface to emit electrons, thereby generating electrons.

* * * * *